US005518848A

United States Patent [19]

Ito et al.

[11] Patent Number: 5,518,848

[45] Date of Patent: May 21, 1996

[54] BINDER RESIN FOR TONERS

[75] Inventors: Hirokazu Ito; Motoshi Inagaki; Masahiro Itoh, all of Toyohashi, Japan

[73] Assignee: Mitsubishi Rayon Co., Ltd., Tokyo, Japan

[21] Appl. No.: 244,903

[22] PCT Filed: Dec. 28, 1992

[86] PCT No.: PCT/JP92/01738

§ 371 Date: Jun. 24, 1994

§ 102(e) Date: Jun. 24, 1994

[87] PCT Pub. No.: WO93/13461

PCT Pub. Date: Jul. 8, 1993

[30] Foreign Application Priority Data

Dec. 26, 1991 [JP] Japan ..... 3-345328
Feb. 27, 1992 [JP] Japan ..... 4-41328

[51] Int. Cl.[6] ..... G03G 9/13; G03G 9/087

[52] U.S. Cl. ..... 430/96; 430/109; 526/264; 526/318.25; 526/318.45; 526/324; 526/347

[58] Field of Search ..... 430/109, 96; 526/318.45, 526/347

[56] References Cited

U.S. PATENT DOCUMENTS 4,246,332 1/1981 Tanaka ..... 430/109
4,449,168 2/1985 Mitsuhashi ..... 430/99
4,626,488 12/1986 Inoue ..... 430/109
5,317,060 5/1994 Kukimoto ..... 525/197

FOREIGN PATENT DOCUMENTS 0332212 9/1989 European Pat. Off. .
0414464 2/1991 European Pat. Off. .
0470448 2/1992 European Pat. Off. .
3027121 2/1981 Germany .
2091435 7/1982 United Kingdom .

OTHER PUBLICATIONS

Patent Abstracts of Japan, vol. 11, No. 331 (P–630), Oct. 29, 1987, JP–A–62 115170, May 26, 1987.

Patent Abstracts of Japan, vol. 14, No. 430 (P–1106), Sep. 14, 1990, JP–A–02 168 264, Jun. 28, 1990.

*Primary Examiner*—Fred Zitomer
*Attorney, Agent, or Firm*—Oblon, Spivak, McClelland, Maier & Neustadt

[57] ABSTRACT

A binder resin for high image quality toners used in copying machines and printers by electrophotography which are excellent in anti-offset property, fixing property, blocking resistance, and image characteristics obtained by controlling the molecular weight, blend ratio, acid value, and ratio of a high molecular weight polymer and a low molecular weight polymer of the binder resin to specific values.

26 Claims, No Drawings

BINDER RESIN FOR TONERS

TECHNICAL FIELD

The present invention relates to a binder resin for high image quality toners used in copying machines and electrophotograph's printers which are excellent in anti-offset property, fixing property, blocking resistance, and image characteristics.

BACKGROUND ART

Typical image forming processes in electrophotography or electrostatic printing comprise a developing step for uniformly charging a photoconductive insulated layer, exposing the insulated layer, dispersing the charges on the exposed portions to form an electrical latent image, and adhering charged fine toner particles on the latent image to make it visible; a transferring step for transferring the visible image thus obtained onto a transfer material such as transfer paper; and a fixing step for permanently fixing it by heat or pressure.

Various performances are required in each of the steps mentioned above for toners and binder resins for toners used in electrophotography or electrostatic printing. For instance, toners and binder resins for toners have to maintain an amount of electrostatic charge appropriate to copying machines without being affected by the surrounding environment such as the temperature and humidity to adhere toners on electrical latent images at the developing step. Also, the anti-offset property, that is, the property of not-adhering to heated rollers, and the fixing property on papers must be excellent at the fixing step in a heated roller fixing method. Further, a blocking resistance, that is, the property of toners not blocking during storage, and excellent image characteristics are also required.

Heretofore, styrene-acrylic type resins have been widely used. Specifically, linear type resins and cross-linked type resins have been used as binder resins for toners. In the linear type resins, resins are known which are prepared by blending a polymer of a high molecular weight with a polymer of a low molecular weight to improve the fixing property and anti-offset property. In the cross-linked type resins, improvements in the fixing property and anti-offset property are being made by broadening the molecular weight distribution by cross-linking. Particularly, considerable research is being carried out on linear type resin. As described in the specifications of Japanese Examined Patent Publication No. 63-32182, Japanese Unexamined Patent Publication No. 62-9356, and others, attempts are being made to improve the fixing property and anti-offset property by controlling the region and molecular weight high molecular weight and low molecular weight resins, respectively. Also, as to the image characteristics, vivid images are being obtained without fogging by controlling the pulverizability of resins to prevent toners and binder resins for toners from overpulverization at the time of printing by means of the blending ratio of the high molecular weight polymer to the low molecular weight polymer.

However, the balance between the fixing property and anti-offset property cannot necessarily be obtained only through the blending of polymers with different molecular weights or through the control of the high molecular weight region and low molecular weight region as well as the molecular weight of resins. Further, copying machines are being increased in speed year by year. Improvement in the fixing property is sought to cope with this through further decrease of the molecular weight of the lower molecular weight polymers. However, toners using toner resins lowered in molecular weight have a low mechanical strength, toners charged through friction with carriers is high speed printing are overpulverized, fogging is produced in the images after printing, and other problems occur in the image characteristics.

With respect to this point, attempts have been made, as described in the specification of Japanese Examined Patent Publication No. 3-48506, in which a relatively high molecular weight polymer is blended to suppress the overpulverization of toners, a super-high molecular weight polymer is blended to improve the anti-offset property, and a low molecular weight polymer is blended to improve the fixing property. However, a satisfactory fixing property cannot be obtained since a relatively high molecular weight polymer and a super-high molecular weight polymer are blended.

Also, with regard to the image characteristics, attempts have been made, paying attention to the charging step which precedes image formation, to introduce an acid monomer to improve the charge buildup as a method for obtaining charges more stably. The introduction of an acid monomer, however, increased the acid value of the resins, and stabilized charge characteristics were not obtained due to the effect of environmental stability, particularly, that of humidity. Further, attempts have also been made to decrease residual monomers and a residual solvent contained in the resins to prevent images from fogging. However, it was difficult to obtain sufficiently vivid images only through the decrease of the residual monomers and solvent.

DISCLOSURE OF THE INVENTION

An object of the present invention is to provide a binder resin for toners excellent in the balance between the fixing property and anti-offset property and excellent in the image characteristics and blocking resistance.

Intensive research was conducted on binder resins for toners by the present inventors. As a result, they found that binder resins for high image quality toners which are excellent in the fixing property, anti-offset property, image characteristics, and blocking resistance and excellent in charge characteristics such as charge buildup can be obtained by controlling the molecular weight, blend ratio, acid value, and ratio of the high molecular weight polymer and low molecular weight polymer.

That is, a binder resin for toners of a first aspect of the present invention comprises a styrene-acrylic copolymer having an acid value ($AV^T$) of not greater than 20 mg KOH/g, having an $AV^H/AV^L$ of 0.025 to 40, not containing or containing not greater than 1000 ppm of residual monomers and/or a residual solvent, having a glass transition temperature of 50° to 68° C., and having a softening temperature of 110° to 145° C.; the copolymer being comprised of 15° to 40% by weight of a high molecular weight polymer having a weight average molecular weight of $3\times10^5$ to $1.5\times10^6$ and having an acid value ($AV^H$) of 0.5 to 20 mg KOH/g and 60 to 85% by weight of a low molecular weight polymer having a weight average molecular weight of $3\times10^3$ to $6\times10^4$ and having an acid value ($AV^L$) of 0.5 to 20 mg KOH/g.

A binder resin for toners of second aspect of the present invention comprises a styrene copolymer prepared from a styrene type monomer and vinyl type monomer or a blend of the copolymer, having at least one maximum value in the region of molecular weight of $10^3$ to $7\times10^4$, having at least one maximum value in the region of molecular weight of $10^5$ to $2\times10^6$, having a shoulder in the region of a molecular weight greater than that of $5\times10^5$ in a molecular weight distribution having a maximum value of the greatest molecular weight, all in a chromatogram measured by gel permeation chromatography, and having a melt viscosity of $3\times10^3$ to $10^5$ Pa.S at 120° C., glass transition temperature of 50° to 68° C., and an acid value of 0.5 to 20 mg KOH/g.

Further, a binder resin for toners of a third aspect of the present invention has at least one peak in each of the regions of molecular weight of $10^3$ to $7\times10^4$ and the region of molecular weight of $10^5$ to $2\times10^6$, having a shoulder in the region of molecular weight less than that of a maximum value of a peak in the region of molecular weight of $2\times10^3$ to $6\times10^4$, all in the molecular weight distribution by gel permeation chromatography, and has a glass transition temperature of 50° to 68° C., a softening temperature of 110° to 145° C., and an acid value of not greater than 40 mg KOH/g.

BEST MODE FOR CARRYING OUT THE INVENTION

The styrene-acrylic copolymer used for the binder resin for toners of the present invention is a copolymer prepared by copolymerizing a styrene type monomer with a radical polymerizable vinyl monomer including an acrylic monomer. The monomers to be used are not particularly restricted. As the styrene type monomer, there may be mentioned styrene, o-methylstyrene, m-methylstyrene, p-methylstyrene, alphamethylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, and 3,4-dichlorostyrene. One or more of the compounds can be used.

As the polymerizable vinyl monomer, there may be mentioned an acrylic monomer, for example, acrylic acid, ethyl acrylate, methyl acrylate, n-butyl acrylate, t-butyl acrylate, 2-ethylhexyl acrylate, isobutyl acrylate, propyl acrylate, dodecyl acrylate, lauryl acrylate, stearyl acrylate, phenyl acrylate, alkyl acrylate, glycidyl acrylate, 2-hydroxymethyl acrylate, 2-hydroxyethyl acrylate, benzyl acrylate, methacrylic acid, ethyl methacrylate, methyl methacrylate, n-butyl methacrylate, t-butyl methacrylate, 2-ethylhexyl methacrylate, isobutyl methacrylate, propyl methacrylate, dodecyl methacrylate, lauryl methacrylate, stearyl methacrylate, phenyl methacrylate, alkyl methacrylate, glycidyl methacrylate, 2-hydroxymethyl methacrylate, 2-hydroxyethyl methacrylate, benzyl methacrylate, dimethylaminoethyl methacrylate, and diethylaminoethyl methacrylate, unsaturated dibasic acid, such as maleic acid, butyl maleate, methyl maleate, dimethyl maleate, fumaric acid, butyl fumarate, dibutyl fumarate, diisopropyl fumarate, dimethyl fumarate, and diethyl fumarate, addition monomer of ε-caprolactam with an acrylic type monomer, and bisphenol A derivative type acrylic monomer. One or more of the compounds can be used.

In the binder resin for toners of the present invention, it is preferable from the viewpoint of the charge characteristics such as charge built up to use 2-ethylhexyl acrylate as a monomer for obtaining a minus charged toner and to use diethylaminoethyl methacrylate for obtaining a plus charged toner. It is preferable to use 2-ethylhexyl acrylate in a range of 5 to 30% by weight. This is because when the amount of the 2-ethylhexyl acrylate is less than 5% by weight, the minus chargeability of the toners will be weak; and when it exceeds 30% by weight, the glass transition temperature of the resin facts and the blocking resistance will become inferior. Also, diethylaminoethyl methacrylate is preferably used in a range of 0.1 to 5% by weight and more preferably in a range of 1 to 4% by weight. The reason is that when the amount of diethylaminoethyl methacrylate is less than 0.1% by weight, the plus chargeability of the toners will be weak, but when it exceeds 5% by weight, the humidity resistance will become inferior.

Further, a chain transfer agent can be used to adjust the molecular weight in the present invention. As the chain transfer agent, alpha-methylstyrene dimer, n-dodecylmercaptan, 2-ethylhexyl thioglycolic acid, and n-octylmercaptan can be mentioned.

The binder resin for toners of the present invention which was obtained from the components mentioned above has a glass transition temperature in a range of 50° to 68° C., preferably in a range of 5° to 66° C. The reasons are that the blocking resistance can be improved without sacrifice of the fixing property by controlling the glass transition temperature of the binder resin for toners in the range mentioned above, that when the glass transition temperature is lower than 50° C., the blocking resistance will be deteriorated and the life of toners becomes worse, and that conversely, when it exceeds 68° C., the fixing property becomes inferior.

Also, the softening temperature of the binder resin for toners is in a range of 110° to 145° C., preferably in a range of 120° to 140° C., from the viewpoint of the fixing property of the toner. This is because when the softening temperature is lower than 110° C., the anti-offset property is inferior and conversely, when it exceeds 145° C., the fixing property will be inferior.

Further, the acid value of the binder resin for toners is in a range not greater than 40 mg KOH/g, preferably not greater than 20 mg KOH/g, and more preferably in a range lower than 15 mg KOH/g. This is because the humidity resistance of the toner becomes excellent and stabilized images without fogging can be obtained so that excellent image characteristics can be obtained by controlling the acid value of the resin in this range. Also, the acid value is preferably greater than 0.5 mg KOH/g.

Such a binder resin for toners of the present invention is composed of a high molecular weight polymer and a lower molecular weight polymer. The molecular weight regions of the high molecular weight polymer and low molecular weight polymer, and their blend ratio contribute to the anti-offset property and fixing property of the toners.

The binder resin for toners of the first aspect of the present invention comprises 15 to 40% by weight of a high molecular weight polymer having a weight average molecular weight of $3\times10^5$ to $1.5\times10^6$ and 60 to 85% by weight of a low molecular weight polymer having a weight average molecular weight of $3\times10^3$ to $6\times10^4$. The resins are excellent in the balance between the fixing property and anti-offset property when the weight average molecular weight of the high molecular weight polymer and low molecular weight polymer and the blend ratio of the polymers are in the ranges mentioned above. The binder resin for toners comprises preferably 20 to 35% by weight of a high molecular weight polymer having a weight average molecular weight of $4\times10^5$ to $9\times10^5$ and 65 to 80% by weight of a low molecular weight polymer having a weight average molecular weight of $4\times10^3$ to $5\times10^4$.

Also, the high molecular weight polymer has an acid value ($AV^H$) of 0.5 to 20 mg KOH/g, the low molecular weight polymer has an acid value ($AV^L$) of 0.5 to 20 mg KOH/g, and the ratio $AV^H/AV^L$ is 0.025 to 40. The binder resin for toners which satisfies these acid values is excellent in humidity resistance and excellent in dispersibility for an additive such as a pigment, charge controlling agent, and wax which are used at the time of toner preparation, thereby the chargeability of the toners is stabilized and vivid images which are not affected by the environment can be obtained. Preferably, the high molecular weight polymer has an acid value ($AV^H$) of 0.5 to 15 mg KOH/g, the low molecular weight polymer has an acid value ($AV^L$) of 0.5 to 15 mg KOH/g, and the ratio $AV^H/AV^L$ is 0.025 to 30.

The reasons for the above are that the ratio of the acid value of a high molecular weight polymer to the acid value of a low molecular weight polymer ($AV^H/AV^L$) is derived in consideration of the balance of the acid value of both polymers from the relationship with the image characteristics; that when the ratio $AV^H/AV^L$ is lower than 0.025, the acid value of the low molecular weight polymer is great, leading to a poor humidity resistance, and thus it is difficult to obtain stabilized images; that conversely, when it exceeds 40, the acid value of the high molecular weight polymer is great, the humidity resistance is poor, production of stabilized images is difficult, and the pulverizability of resins is inferior; that when the acid values of the high molecular weight polymer and low molecular weight polymer are less than 0.5 mg KOH/g, preparation of the resin is difficult; and that conversely, when the acid values exceed 20 mg KOH/g, the humidity resistance is inferior and stabilized images can hardly be obtained.

Further, it is important that the amount of the residual monomers and/or a residual solvent be in a range of less than 1000 ppm from the viewpoint of the image characteristics, and the amount be preferably less than 800 ppm. This is because when the amount of the residual monomers and/or a residual solvent exceeds 1000 ppm, fogging easy occurs and vivid images can hardly be obtained.

The binder resin for toners of the second aspect of the present invention has a greatest peaks in each of the low molecular weight region of molecular weight of $10^3$ to $7\times10^4$ and the high molecular weight region of molecular weight of $10^5$ to $2\times10^6$, respectively, and has a shoulder in the region of a molecular weight greater than $5\times10^5$ of the greatest peak in the high molecular weight region both in a chromatogram by gel permeation chromatography. The binder resin for toners having a greatest peak in such a specific region is preferably excellent in the balance between the fixing property and anti-offset property of toners. When the greatest peak in the low molecular weight region exists outside the molecular weight region of $10^3$ to $7\times10^4$, the fixing property of the toners is inferior. When the greatest peak in the high molecular weight region exists outside the molecular weight region of $10^5$ to $2\times10^5$, the anti-offset property of the toners is unpreferably inferior. Also, the anti-offset property of the toners is excellent due to the fact that it has a shoulder in the range of molecular weight greater than that of of $5\times10^5$ of the greatest peak in the high molecular weight region. It preferably has a shoulder in a region of $6\times10^5$ to $2\times10^6$. Particularly, a resin having a shoulder in a region of $6\times10^5$ to $10^6$ is excellent in the balance between the fixing property and anti-offset property.

Further, the binder resin for toners of the third aspect of the present invention has a peak in the low molecular weight region of a molecular weight of $10^3$ to $7\times10^4$ and the high molecular weight region of a molecular weight of $10^5$ to $2\times10^6$, and has a shoulder in a range of a molecular weight less than that of a maximum value of the greatest peak in the low molecular weight region both in a chromatogram measured by gel permeation chromatography. The binder resin for toners having a peak in such a specific region is excellent in the balance between the fixing property and anti-offset property of toners. Besides, it is more preferable to have a peak in the low molecular weight region of a molecular weight of $2\times10^3$ to $6\times10^4$ and in the high molecular weight region of a molecular weight of $3\times10^5$ to $2\times10^6$. When the greatest peak in the low molecular weight region exists outside the molecular weight region of $2\times10^3$ to $6\times10^4$, the fixing property of the toners is inferior. When the greatest peak in the high molecular weight region exists outside the molecular weight of $3\times10^5$ to $2\times10^6$, the anti-offset property of toners is unpreferably inferior. Also, having a shoulder in the region of a molecular weight less than that of a maximum value of the greatest peak in the low molecular weight region of a molecular weight of $2\times10^3$ to $6\times10^4$, the melting of the binder resin at a low temperature becomes sharp and the fixing property of toners becomes considerably excellent. The term "shoulder" in the molecular weight distribution in the present invention means a portion of inflection other than the maximum and minimum values.

In the present invention, the high molecular weight polymer having a greatest peak in the high molecular weight region in a chromatogram by gel permeation chromatography is contained in the binder resin preferably in an amount of 15 to 45% by weight and more preferably in an amount of 20 to 40% by weight. This is because when the content of the high molecular weight polymer is less than 15% by weight, the anti-offset property is inferior, and conversely, when it exceeds 45% by weight, the fixing property tends to become insufficient.

In the binder resin for toners of the present invention, a polymer of specific molecular weight regions may be formed in a polymerization stage of the resin or polymers having a specific molecular weight may be blended in order to produce a shoulder in a specific molecular weight region. For instance, when it has a shoulder in the region of molecular weight less than that of the maximum value of the greatest peak existing in the molecular weight of $2\times10^3$ to $6\times10^4$, it is sufficient to include a styrene-acrylic copolymer having a weight average molecular weight of less than $6\times10^3$ and a glass transition temperature of 35° to 65° C. in a range of 0.3 to 30% by weight.

In the present invention, it is preferable that the difference between the molecular weight ($M_W^H$) of the greatest peak in the high molecular weight region and the molecular weight ($M_W^L$) of the greatest peak in the low molecular weight region be in a range of $2\times10^5$ to $1\times10^6$. That is, $M_W^H$ and $M_W^L$ are preferably in the relationship represented by the following equation (1):

$$1\times10^6 \geqq M_W^H - M_W^L \geqq 2\times10^5 \quad (1)$$

The components of the binder resin of the present invention in the high molecular weight region contribute to the improvement of the anti-offset property of the toners, and the components in the low molecular weight region contribute to the improvement of the fixing property. Since the difference between the molecular weight ($M_W^H$) of the greatest peak in the high molecular weight region and the molecular weight ($M_W^L$) of the greatest peak in the low molecular weight region is in a range which satisfies the equation (1) mentioned above, toners can be obtained which are excellent in the balance between the fixing property and anti-offset property. When the difference in the molecular weight ($M_W^H - M_W^L$) is less than $2\times10^5$, the anti-offset property of toners tends to become insufficient. Conversely, when it exceeds $1\times10^6$, the fixing property tends to become inferior. The molecular weight difference ($M_W^H-M_W^L$) is more preferably in the range of $2.5\times10^5$ to $9\times10^5$.

In the present invention, the ratio of the weight average molecular weight ($M_W$) to the number average ($M_n$) molecular weight of the binder resin for toners is preferably 15 to 70 and more preferably in a range of 20 to 60. The reason is that resins having the ratio $M_W/M_n$ in this range are remarkably excellent in the balance between the fixing property and anti-offset property. When the ratio $M_W/M_n$ is lower than 15, the anti-offset property tends to become insufficient, and conversely when it exceeds 70, the fixing property tends to become insufficient.

Further, it is necessary that the melt viscosity of binder resin for toners at 120° C. be in the range of $3\times10^3$ to $10^5$ Pa.S, more preferably in the range of $8\times10^3$ to $8\times10^4$ Pa.S. When a resin having a melt viscosity of this range is used, the fixing property of the toners becomes excellent and the overpulverization of toners can be prevented.

The methods for producing the binder resin for toners of the present invention are not particularly restricted. Polymers having different molecular weight distributions may be blended, melted, and kneaded in an extruder, kneader, or mixer. The resin may be produced by a polymerization method such as a suspension polymerization method, solution polymerization method, emulsion polymerization method, or bulk polymerization method, or a combination of the methods. In the present invention, it is preferable to use a combination of emulsion polymerization and suspension polymerization or suspension polymerizational one. For instance, a high molecular weight polymer having a peak in the range of molecular weight of $3\times10^5$ to $2\times10^6$ is first prepared by emulsion polymerization or suspension polymerization and then a low molecular weight polymer having a peak in the range of a molecular weight of $2\times10^3$ to $6\times10^4$ is prepared by suspension polymerization. In this case, the succeeding suspension polymerization is carried out preferably at a temperature higher than 100° C. and more preferably at a temperature higher than 125° C. Also, it is preferable to raise the temperature to higher than the temperature for the suspension polymerization at the latter period of the suspension polymerization. The temperature is increased preferably by more than 3° C., more desirably more than 5° C.

Further, it is preferable to carry out heat treatment and/or distillation at a temperature higher than 90° C. after the polymerization to eliminate residual monomers or residual solvents, in order to obtain vivid images. Particularly, when heat treatment is performed, it is preferable to use a polymerization initiator designed aim for elimination of residual monomers. When distillation is performed, it is preferably carried at a temperature higher than 100° C. Thereafter, it is preferable to conduct an alkali treatment at a temperature higher than the glass transition temperature of the resin to eliminate by-products when a peroxide type initiator is used.

In the polymerization for the binder resin for toners of the present invention, one or more kinds of radical polymerization catalysts such as a peroxide type initiator and azo type initiator can be used. As the radical polymerization catalyst, there may be mentioned, for example, potassium persulfate, benzoyl peroxide, t-butylperoxybenzoate, 2,2-azobis(2-methylbutyronitrile), and 1,1-azobis(cyclohexane-1-carbonitrile).

The present invention will be specifically described below with reference to examples.

In the following examples, "weight average molecular weight" is a value determined by gel permeation chromatography in which tetrahydrofuran was used as a solvent, measurement was carried out with a HCL-8020 manufactured by Toso Co., Ltd., and the value was obtained by polystyrene conversion.

The acid value was obtained by the titration method with KOH in a toluene solvent. The molecular weight was obtained by measuring it with a HCL-8020 manufactured by Toso Co., Ltd, and then polystyrene conversion.

The glass transition temperature (Tg) was obtained from the temperature at which a base line of a chart which was obtained by melt quenching a sample at 100° C. and then measuring with a differential calorimeter at a rate of temperature rise of 10° C./min intersects with a tangent line of a endothermic curve at the neighborhood of Tg.

The softening temperature was determined by measuring at the conditions of a load of 30 kgf, rate of temperature rise of 3° C./min, and a nozzle of 1.0 mmϕ×10 mm using a flow tester CFT-500 manufactured by SHIMADZU CORPORATION, and measuring the temperature at which ½ of the sample flowed out, which was assumed to be the softening temperature.

The contents of the residual monomers and a residual solvent were obtained by gas chromatography.

The melt viscosity was measured using a flow tester with a nozzle of 1.0 mmϕ×10 mm (CFT-500 manufactured by SHIMADZU CORPORATION) under a load of 30 kgf and at a constant rate of temperature rise of 3° C./min.

[Preparation examples, examples and comparative examples of first aspect of the present invention]

Preparation Example 1

A mixture of 6000 parts by weight of deionized water and 5 parts by weight of a reactive emulsifying agent of an allyl alcohol derivative was placed in a reaction vessel provided with a thermometer, stirrer, and distillation column, then a mixture of 780 parts by weight of styrene, 200 parts by weight of 2-ethylhexyl acrylate, 20 parts by weight of methacrylic acid, and 2.5 parts by weight of potassium persulfate was added. Thereafter, nitrogen gas was introduced in the reaction vessel, nitrogen substitution was carried out for about 1 hour, the rotating speed of the stirrer was maintained at 150 rpm, the temperature of the reaction system was increased up to 72° C., and emulsion polymerization was carried out for about 3 hours to obtain an emulsion. Then, the temperature of the reaction system was increased up to 100° C., and 1200 cc of a liquid mixture of residual monomers and deionized water was discharged. Thereafter, the temperature was decreased to salt out the emulsion to obtain the resin 1. The resin 1 thus obtained had an acid value of 11.3 mg KOH/g and a weight average molecular weight of $7.5\times10^5$.

Preparation Example 2

A mixture of 6000 parts by weight of deionized water and 5 parts by weight of a reactive emulsifying agent of an allyl alcohol derivative was placed in a reaction vessel provided with a thermometer, stirrer, and distillation column, then a mixture of 795 parts by weight of styrene, 200 parts by weight of 2-ethylhexyl acrylate, 5 parts by weight of methacrylic acid, and 3 parts by weight of potassium persulfate was added. Thereafter, nitrogen gas was introduced in the reaction vessel, nitrogen substitution was carried out for about 1 hour, the rotating speed of the stirrer was maintained at 150 rpm, the temperature of the reaction system was increased up to 75° C., and emulsion polymerization was carried out for about 3 hours to obtain an emulsion. Then, the temperature of the reaction system was increased up to 100° C., and 1200 cc of a liquid mixture of residual monomers and deionized water was discharged. Thereafter, the temperature was decreased to salt out the emulsion to obtain the resin 2. The resin 2 thus obtained had an acid value of 3.2 mg KOH/g and a weight average molecular weight of $4.5\times10^5$.

Preparation Example 3

A mixture of 6000 parts by weight of deionized water and 5 parts by weight of a reactive emulsifying agent of an allyl alcohol derivative was placed in a reaction vessel provided with a thermometer, stirrer, and distillation column, then a mixture of 770 parts by weight of styrene, 200 parts by weight of 2-ethylhexyl acrylate, 30 parts by weight of methacrylic acid, and 2 parts by weight of potassium persulfate was added. Thereafter, nitrogen gas was introduced in the reaction vessel, nitrogen substitution was carried out for about 1 hour, the rotating speed of the stirrer was maintained at 150 rpm, the temperature of the reaction system was increased up to 68° C., and emulsion polymerization was carried out for about 3 hours to obtain an emulsion. Then, the temperature of the reaction system was increased up to 100° C., and 1200° C. of a liquid mixture of residual monomers and deionized water was discharged. Thereafter, the temperature was decreased to salt out the emulsion to obtain the resin 3. The resin 3 thus obtained had an acid value of 18.2 mg KOH/g and a weight average molecular weight of $1.05\times10^6$.

Preparation Example 4

A mixture of 6000 parts by weight of deionized water and 5 parts by weight of a reactive emulsifying agent of an allyl alcohol derivative was placed in a reaction vessel provided with a thermometer, stirrer, and distillation column, then a mixture of 795 parts by weight of styrene, 200 parts by weight of n-butyl acrylate, 5 parts by weight of methacrylic acid, and 2.5 parts by weight of potassium persulfate was added. Thereafter, nitrogen gas was introduced in the reaction vessel, nitrogen substitution was carried out for about 1 hour, the rotating speed of the stirrer was maintained at 150 rpm, the temperature of the reaction system was increased up to 72° C., and emulsion polymerization was carried out for about 3 hours to obtain an emulsion. Then, the temperature of the reaction system was increased up to 100° C., and 1200 cc of a liquid mixture of residual monomers and deionized water was discharged. Thereafter, the temperature was decreased to salt out the emulsion to obtain the resin 4. The resin 4 thus obtained had an acid value of 3.3 mg KOH/g and a weight average molecular weight of $7.5\times10^5$.

Preparation Example 5

A mixture of 2000 parts by weight of deionized water and 4.5 parts by weight of a polyvinyl alcohol was placed in a reaction vessel provided with a thermometer, stirrer, and distillation column, then a liquid mixture of 780 parts by weight of styrene, 200 parts by weight of 2-ethylhexyl acrylate, 20 parts by weight of methacrylic acid, and 10 parts by weight of alpha-methylstyrene dimer was added, 80 parts by weight of benzoyl peroxide and 10 parts by weight of t-butyl peroxybenzoate were further added while maintaining the rotating speed of the stirrer at 350 rpm. Thereafter, the temperature of the reaction system was increased up to 130° C. in about 30 minutes while maintaining the reaction vessel in a closed condition, and suspension polymerization was carried out for about 2 hours. Then, the temperature of the reaction system was decreased down to 100° C., the reaction system was brought back to an atmospheric pressure, and about 400 cc of residual monomers was discharged outside the reaction system together with deionized water. Thereafter, the reaction system was kept at 90° C., added with 15 parts by weight of sodium hydroxide, and subjected to alkali treatment for about 30 minutes. The reaction system was cooled down to room temperature to obtain the resin 5. The resin 5 thus obtained had an acid value of 12.9 mg KOH/g and a weight average molecular weight of $9\times10^3$.

Preparation Example 6

A mixture of 2000 parts by weight of deionized water and 4.5 parts by weight of a polyvinyl alcohol was placed in a reaction vessel provided with a thermometer, stirrer, and distillation column, then a mixture of 795 parts by weight of styrene, 200 parts by weight of 2-ethylhexyl acrylate, 5 parts by weight of methacrylic acid, and 15 parts by weight of alpha-methylstyrene dimer was added. 80 parts by weight of benzoyl peroxide and 10 parts by weight of t-butyl peroxybenzoate were further added while maintaining the rotating speed of the stirrer at 350 rpm. Thereafter, the temperature of the reaction system was increased up to 130° C. in about 30 minutes while maintaining the reaction vessel in a closed condition, and suspension polymerization was carried out for about 2 hours. Then, the temperature of the reaction system was decreased down to 100° C., the reaction system was brought back to atmospheric pressure, and about 400 cc of residual monomers was discharged outside the reaction system together with deionized water. Thereafter, the temperature of the reaction system was kept at 90° C., added with 15 parts by weight of sodium hydroxide, and subjected to alkali treatment for about 30 minutes. The reaction system was cooled down to room temperature to obtain the resin 6. The resin 6 thus obtained had an acid value of 2.9 mg KOH/g and a weight average molecular weight of $4.5\times10^3$.

Preparation Example 7

A mixture of 2000 parts by weight of deionized water and 4.5 parts by weight of a polyvinyl alcohol was placed in a reaction vessel provided with a thermometer, stirrer, and distillation column, then a liquid mixture of 770 parts by weight of styrene, 200 parts by weight of 2-ethylhexyl acrylate, 30 parts by weight of methacrylic acid, and 5 parts by weight of alpha-methylstyrene dimer was added. 80 parts by weight of benzoyl peroxide and 10 parts by weight of t-butyl peroxybenzoate were further added while maintaining the rotating speed of the stirrer at 350 rpm. Thereafter, the temperature of the reaction system was increased up to 88° C. in about 30 minutes while maintaining the reaction vessel in atmospheric pressure, and suspension polymerization was carried out for about 2 hours. Then, the temperature of the reaction system was increased up to 100° C. and about 400 cc of residual monomers was discharged outside the reaction system together with deionized water. Thereafter, the temperature of the reaction system was kept at 90° C., added with 15 parts by weight of sodium hydroxide, and subjected to alkali treatment for about 30 minutes. The reaction system was cooled down to room temperature to obtain the resin 7. The resin 7 thus obtained had an acid value of 18.9 mg KOH/g and a weight average molecular weight of $1.75\times10^4$.

Preparation Example 8

A mixture of 2000 parts by weight of deionized water and 4.5 parts by weight of a polyvinyl alcohol was placed in a reaction vessel provided with a thermometer, stirrer, and distillation column, then a mixture of 795 parts by weight of styrene, 170 parts by weight of n-butyl acrylate, 5 parts by weight of methacrylic acid, and 30 parts by weight of diethylaminoethyl methacrylate was added. 70 parts by weight of 2,2-azobis(2-methylbutyronitrile) was further added while maintaining the rotating speed of the stirrer at 350 rpm. Thereafter, the temperature of the reaction system was increased up to 78° C. in about 30 minutes while maintaining the reaction vessel at an atmospheric pressure, and suspension polymerization was carried out for about 2 hours. Then, the temperature of the reaction system was increased up to 100° C. and about 400 cc of residual monomers was discharged outside the reaction system together with deionized water. Thereafter, the reaction system was cooled down to room temperature to obtain the resin 8. The resin 8 thus obtained had an acid value of 2.9 mg KOH/g and a weight average molecular weight of $2.85\times10^4$.

Preparation Example 9

A mixture of 2000 parts by weight of deionized water and 4.5 parts by weight of a polyvinyl alcohol was placed in a reaction vessel provided with a thermometer, stirrer, and distillation column, then a liquid mixture of 795 parts by weight of styrene, 190 parts by weight of n-butyl acrylate, 5 parts by weight of methacrylic acid, and 10 parts by weight of diethylaminoethyl methacrylate was added. 80 parts by weight of 2,2-azobis(2-methylbutyronitrile) and 10 parts by weight of 1,1-azobis (cyclohexane-1-carbonitrile) were further added while maintaining the rotating speed of the stirrer at 350 rpm. Thereafter, the temperature of the reaction system was increased up to 100° C. in about 30 minutes while maintaining the reaction vessel in a closed condition, and suspension polymerization was carried out for about 2 hours. Then, about 400 cc of residual monomers was discharged outside the reaction system together with deionized water while maintaining the temperature of the reaction system at 100° C. Thereafter, the reaction system was cooled down to room temperature to obtain the resin 9. The resin 9 thus obtained had an acid value of 2.5 mg KOH/g and a weight average molecular weight of $8.5\times10^3$.

Preparation Example 10

A liquid mixture of 2000 parts by weight of deionized water and 4.5 parts by weight of a polyvinyl alcohol was placed in a reaction vessel provided with a thermometer, stirrer, and distillation column, then a mixture of 790 parts by weight of styrene, 150 parts by weight of n-butyl acrylate, 5 parts by weight of methacrylic acid and 50 parts by weight of diethylaminoethyl methacrylate was added. 50 parts by weight of 2,2-azobis(2-methylbutyronitrile) was further added while maintaining the rotating speed of the stirrer at 350 rpm. Thereafter, the temperature of the reaction system was increased up to 78° C. in about 30 minutes while maintaining the reaction vessel at an atmospheric pressure, and suspension polymerization was carried out for about 2 hours. Then, the temperature of the reaction system was increased up to 100° C., and about 400 cc of residual monomers was discharged outside the reaction system together with deionized water. Thereafter, the reaction system was cooled down to room temperature to obtain the resin 10. The resin 10 thus obtained had an acid value of 2.1 mg KOH/g and a weight average molecular weight of $5.55\times10^4$.

Preparation Example 11

A mixture of 6000 parts by weight of deionized water and 5 parts by weight of a reactive emulsifying agent of an allyl alcohol derivative was placed in a reaction vessel provided with a thermometer, stirrer, and distillation column, then a liquid mixture of 800 parts by weight of styrene, 200 parts by weight of n-butyl acrylate, and 2.5 parts by weight of potassium persulfate was added. Thereafter, nitrogen gas was introduced in the reaction vessel, nitrogen substitution was carried out for about 1 hour, the rotating speed of the stirrer was maintained at 150 rpm, the temperature of the reaction system was increased up to 72° C., and emulsion polymerization was carried out for about 3 hours to obtain an emulsion. Then, the temperature of the reaction system was increased up to 100° C. and 1200 cc of a mixture of residual monomers and deionized water was discharged. Thereafter, the temperature was decreased to salt out the emulsion to obtain the resin 11. The resin 11 thus obtained had an acid value of 0.5 mg KOH/g and a weight average molecular weight of $7\times10^5$.

Preparation Example 12

A liquid mixture of 2000 parts by weight of deionized water and 4.5 parts by weight of a polyvinyl alcohol was placed in a reaction vessel provided with a thermometer, stirrer, and distillation column, then a liquid mixture of 800 parts by weight of styrene, 200 parts by weight of n-butyl acrylate, and 10 parts by weight of alpha-methylstyrene dimer was added. 80 parts by weight of benzoyl peroxide and 10 parts by weight of t-butylperoxybenzoate were further added while maintaining the rotating speed of the stirrer at 350 rpm. Thereafter, the temperature of the reaction system was increased up to 130° C. in about 30 minutes while maintaining the reaction vessel in a closed condition, and suspension polymerization was carried out for about 2 hours. Then, the temperature of the reaction system was decreased down to 100° C., the reaction system was brought back to atmospheric pressure, and about 400 cc of residual monomers was discharged outside the reaction system together with deionized water. Thereafter, the reaction system was maintained at 90° C., added with 15 parts by weight of sodium hydroxide, and subjected to alkali treatment for about 30 minutes. The reaction system was cooled down to room temperature to obtain the resin 12. The resin 12 thus obtained had an acid value of 0.5 mg KOH/g and a weight average molecular weight of $8.7\times10^3$.

Preparation Example 13

A liquid mixture of 6000 parts by weight of deionized water and 5 parts by weight of a reactive emulsifying agent of an allyl alcohol derivative was placed in a reaction vessel provided with a thermometer, stirrer, and distillation column, then a liquid mixture of 660 parts by weight of styrene, 300 parts by weight of n-butyl acrylate, 40 parts by weight of methacrylic acid, and 2.5 parts by weight of potassium persulfate was added. Thereafter, nitrogen gas was introduced in the reaction vessel, nitrogen substitution was carried out for about 1 hour, the rotating speed of the stirrer was maintained at 150 rpm, the temperature of the reaction system was increased up to 72° C., and emulsion polymerization was carried out for about 3 hours to obtain an emulsion. Then, the temperature of the reaction system was increased up to 100° C., and 1200 cc of a liquid mixture of residual monomers and deionized water was discharged. Thereafter, the temperature was decreased to salt out the emulsion to obtain the resin 13. The resin 13 thus obtained had an acid value of 26.5 mg KOH/g and a weight average molecular weight of $7.5\times10^5$.

Preparation Example 14

A mixture of 2000 parts by weight of deionized water and 4.5 parts by weight of a polyvinyl alcohol was placed in a reaction vessel provided with a thermometer, stirrer, and distillation column, then a liquid mixture of 660 parts by weight of styrene, 300 parts by weight of n-butyl acrylate, 40 parts by weight of methacrylic acid, and 10 parts by weight of alpha-methylstyrene dimer was added. 80 parts by weight of benzoyl peroxide and 10 parts by weight of t-butylperoxybenzoate were further added while maintaining the rotating speed of the stirrer at 350 rpm. Thereafter, the temperature of the reaction system was increased up to 130° C. in about 30 minutes while maintaining the reaction vessel in a closed condition, and suspension polymerization was carried out for about 2 hours. Then, the temperature of the reaction system was decreased down to 100° C., the reaction system was brought back to atmospheric pressure, and about 400 cc of residual monomers was discharged outside the reaction system together with deionized water. Thereafter, the reaction system was maintained at 90° C., added with 15 parts by weight of sodium hydroxide, and subjected to alkali treatment for about 30 minutes. The reaction system was cooled down to room temperature to obtain the resin 14. The resin 14 thus obtained had an acid value of 26.mg KOH/g and a weight average molecular weight of $9\times10^3$.

Preparation Example 15

A liquid mixture of 6000 parts by weight of deionized water and 5 parts by weight of a reactive emulsifying agent of an allyl alcohol derivative was placed in a reaction vessel provided with a thermometer, stirrer, and distillation column, then a liquid mixture of 795 parts by weight of styrene, 200 parts by weight of n-butyl acrylate, 5 parts by weight of methacrylic acid, and 2.5 parts by weight of potassium persulfate was added. Then, nitrogen gas was introduced in the reaction vessel, nitrogen substitution was carried out for about 1 hour, the rotating speed of the stirrer was maintained at 150 rpm, the temperature of the reaction system was increased up to 72° C., and emulsion polymerization was carried out for about 3 hours to obtain an emulsion. Thereafter, the temperature was decreased to salt out the emulsion to obtain the resin 15. The resin 15 thus obtained had an acid value of 3.3 mg KOH/g and a weight average molecular weight of $7.5\times10^5$.

Preparation Example 16

A liquid mixture of 2000 parts by weight of deionized water and 4.5 parts by weight of a polyvinyl alcohol was placed in a reaction vessel provided with a thermometer, stirrer, and distillation column, then a liquid mixture of 795 parts by weight of styrene, 190 parts by weight of n-butyl acrylate, 5 parts by weight of methacrylic acid, and 10 parts by weight of diethylaminoethyl methacrylate was added. 80 parts by weight of 2,2-azobis(2-methylbutyronitrile) and 10 parts by weight of 1,1-azobis(cyclohexane-1-carbonitrile) were further added while maintaining the rotating speed of the stirrer at 350 rpm. Thereafter, the temperature of the reaction system was increased up to 100° C. in about 30 minutes while maintaining the reaction vessel in a closed condition, and suspension polymerization was carried out for about 2 hours. Then, the temperature of the reaction system was decreased down to room temperature to obtain the resin 16. The resin 16 thus obtained had an acid value of 2.5 mg KOH/g and a weight average molecular weight of $8.5\times10^3$.

EXAMPLE 1

An amount of 20 parts by weight of the resin 1 obtained in Preparation Example 1 and 80 parts by weight of the resin 5 obtained in Preparation Example 5 were blended by using a mixer at 180° C. to obtain a binder resin for toners. The binder resin for toners thus obtained had a glass transition temperature of 64° C., softening temperature of 135° C., acid value of 12.5 mg KOH/g, and $AV^H/AV^L$ of 0.88. Also, two peaks existed in the high molecular weight region and low molecular weight region in the molecular weight distribution by gel permeation chromatography. The weight average molecular weight in the high molecular weight region was $6.8\times10^5$, and the weight average molecular weight in the low molecular region was $9.1\times10^3$. Further, the amount of the residual monomers was less than 50 ppm.

On the other hand, 92 parts by weight of the binder resin thus obtained, 5 parts by weight of carbon black, and 3 parts by weight of a low molecular weight polypropylene wax were blended, kneaded by using a twin-screw extruder under the condition of 150° C., cooled down, pulverized, and classified to produce a toner. As a result of the evaluation of toner characteristics of the toner thus obtained by using a copying machine for minus charge, all of the fixing property, anti-offset property, and blocking resistance were excellent. Also, as to image characteristics, vivid images having no fogging were obtained. Further, as to built up chargeability, it was largely charged to minus. The amount of charges was stabilized in 5 minutes to show a good result.

Further, the fixing property and anti-offset property were evaluated by using a copying machine for a minus charge toner or plus charge toner with a variable copying speed. The set printing speed was 500 mm/sec. The image characteristics were evaluated by using a copying machine for a minus a charge toner or plus charge toner with a variable copying speed. The printing speed was set at 500 mm/sec, 5000 copies were made at a temperature at which the toner is sufficiently fixed, and the fogging was looked for in the images thus obtained. The built-up chargeability was evaluated by mixing a carrier and a toner with a ball mill, measuring the charged amount with a blowoff measuring apparatus, and measuring the period of time until the amount of charges was stabilized. The blocking resistance was evaluated by the coagulation state of toners 50 hours after 1 g of a toner was left as it is in a hot air dryer kept at 50° C.

EXAMPLE 2

A binder resin for toners was obtained under the same conditions as in Example 1 except that 38 parts by weight of the resin 2 obtained in Preparation Example 2 and 62 parts by weight of the resin 5 obtained in Preparation Example 5 were used. The binder resin for toners thus obtained had a glass transition temperature of 66° C., softening temperature of 138° C., acid value of 9.2 mg KOH/g, and $AV^H/AV^L$ of 0.24. Also, two peaks existed in a high molecular weight region and low molecular weight region in the molecular weight distribution by gel permeation chromatography, the weight average molecular weight in the high molecular weight region was $3.9\times10^5$, and the weight average molecular weight in the low molecular region was $9\times10^3$. Further, the amount of the residual monomers was less than 50 ppm.

The binder resin for toners was made into a toner by the same method as in Example 1 and evaluated for its toner characteristics by the same method as in Example 1 by using a copying machine for a minus charge. As a result, all of the fixing property, anti-offset property, and blocking resistance were excellent. Also, as to the image characteristics, vivid images without fogging were obtained. Further, as to the built-up chargeability, it was largely charged to minus and the amount of the charges was preferably stabilized in 3 minutes.

EXAMPLE 3

A binder resin for toners was obtained under the same conditions as in Example 1 except that 30 parts by weight of the resin 2 obtained in Preparation Example 2 and 70 parts by weight of the resin 7 obtained in Preparation Example 7 were used. The binder resin for toners thus obtained had a glass transition temperature of 62° C., softening temperature of 143° C., acid value of 14.19 mg KOH/g, and $AV^H/AV^L$ of 0.174. Also, two peaks existed in a high molecular weight region and low molecular weight region in the molecular weight distribution by gel permeation chromatography, the weight average molecular weight in the high molecular weight region was $3.91\times10^5$, and the weight average molecular weight in the low molecular region was $1.7\times10^4$. Further, the amount of the residual monomers was less than 50 ppm.

The binder resin for toners was made into a toner by the same method as in Example 1 and evaluated for its toner characteristics by the same method as in Example 1 by using a copying machine for a minus charge. As a result, both the anti-offset property and blocking resistance were excellent. While the fixing property was slightly inferior, it was of such an extent that the toner practically caused no problem. Also, as to the image characteristics, vivid images without fogging were obtained. Further, as to the built-up chargeability, it was largely charged to minus and the amount of the charges was preferably stabilized in 6 minutes.

EXAMPLE 4

A binder resin for toners was obtained under the same conditions as in Example 1 except that 17 parts by weight of the resin 3 obtained in Preparation Example 3 and 83 parts by weight of the resin 6 obtained in Preparation Example 6 were used. The binder resin for toners thus obtained had a glass transition temperature of 57° C., softening temperature of 121° C., acid value of 7.3 mg KOH/g, and $AV^H/AV^L$ of 6.48. Also, two peaks existed in a high molecular weight region and low molecular weight region in the molecular weight distribution by gel permeation chromatography, the weight average molecular weight in the high molecular weight region was $9\times10^5$, and the weight average molecular weight in the low molecular region was $4.6\times10^3$. Further, the amount of the residual monomers was less than 50 ppm.

The binder resin for toners was made into a toner by the same method as in Example 1 and evaluated for its toner characteristics by the same method as in Example 1 by using a copying machine for a minus charge. As a result, all of the fixing property, anti-offset property, and blocking resistance were excellent. Also, as to the image characteristics, vivid images without fogging were obtained. Further, as to the built-up chargeability, it was largely charged to minus and the amount of the charges was preferably stabilized in 3 minutes.

EXAMPLE 5

A binder resin for toners was obtained under the same conditions as in Example 1 except that 17 parts by weight of the resin 11 obtained in Preparation Example 11 and 83 parts by weight of the resin 7 obtained in Preparation Example 7 were used. The binder resin for toners thus obtained had a glass transition temperature of 58° C., softening temperature of 123° C., acid value of 15.7 mg KOH/g, and $AV^H/AV^L$ of 0.03. Also, two peaks existed in a high molecular weight region and low molecular weight region in the molecular weight distribution by gel permeation chromatography, the weight average molecular weight in the high molecular weight region was $6.1\times10^5$, and the weight average molecular weight in the low molecular region was $1.76\times10^4$. Further, the amount of the residual monomers was less than 50 ppm.

The binder resin for toners was made into a toner by the same method as in Example 1 and evaluated for its toner characteristics by the same method as in Example 1 by using a copying machine for a minus charge. As a result, all of the fixing property, anti-offset property, and blocking resistance were excellent. Also, as to the image characteristics, vivid images without fogging were obtained. Further, as to the built-up chargeability, it was largely charged to minus and the amount of the charges was preferably stabilized in 6 minutes.

EXAMPLE 6

A binder resin for toners was obtained under the same conditions as in Example 1 except that 35 parts by weight of the resin 3 obtained in Preparation Example 3 and 65 parts by weight of the resin 12 obtained in Preparation Example 12 were used. The binder resin for toners thus obtained had a glass transition temperature of 60° C., softening temperature of 134° C., acid value of 6.9 mg KOH/g, and $AV^H/AV^L$ of 37.6. Also, two peaks existed in a high molecular weight region and low molecular weight region in the molecular weight distribution by gel permeation chromatography, the weight average molecular weight in the high molecular weight region was $9\times10^6$, and the weight average molecular weight in the low molecular region was $8.6\times10^3$. Further, the amount of the residual monomers was less than 50 ppm.

The binder resin for toners was made into a toner by the same method as in Example 1 and evaluated for its toner characteristics by the same method as in Example 1 by using a copying machine for a minus charge. As a result, all of the fixing property, anti-offset property, and blocking resistance were excellent. Also, as to the image characteristics, vivid images without fogging were obtained. Further, as to the built-up chargeability, it was largely charged to minus and the amount of the charges was preferably stabilized in 3 minutes.

EXAMPLE 7

A binder resin for toners was obtained under the same conditions as in Example 1 except that 17 parts by weight of the resin 3 obtained in Preparation Example 3 and 83 parts by weight of the resin 12 obtained in Preparation Example 12 were used. The binder resin for toners thus obtained had a glass transition temperature of 55° C., softening temperature of 118° C., acid value of 2.4 mg KOH/g, and $AV^H/AV^L$ of 22.6. Also, two peaks existed in a high molecular weight region and low molecular weight region in the molecular weight distribution by gel permeation chromatography, the weight average molecular weight in the high molecular weight region was $6.8\times10^6$, and the weight average molecular weight in the low molecular region was $8.6\times10^3$. Further, the amount of the residual monomers was about 55 ppm.

The binder resin for toners was made into a toner by the same method as in Example 1 and evaluated for its toner characteristics by the same method as in Example 1 by using a copying machine for a minus charge. As a result, all of the fixing property, anti-offset property, and blocking property were excellent. Also, as to the image characteristics, vivid images without fogging were obtained. Further, as to the built-up chargeability, it was largely charged to minus and the amount of the charges was preferably stabilized in 3 minutes.

EXAMPLE 8

A binder resin for toners was obtained under the same conditions as in Example 1 except that 30 parts by weight of the resin obtained in Preparation Example and 70 parts by weight of the resin 8 obtained in Preparation Example 8 were used. The binder resin for toners thus obtained had a glass transition temperature of 58° C., softening temperature of 131° C., acid value of 3.1 mg KOH/g, and $AV^H/AV^L$ of 1.14. Also, two peaks existed in a high molecular weight region and low molecular weight region in the molecular weight distribution by gel permeation chromatography, the weight average molecular weight in the high molecular weight region was $6.85\times10^5$, and the weight average molecular weight in the low molecular region was $2.86\times10^4$. Further, the amount of the residual monomers was about 300 ppm.

The binder resin for toners was made into a toner by the same method as in Example 1 and evaluated for its toner characteristics by the same method as in Example 1 by using a copying machine for a plus charge. As a result, all of the fixing property, anti-offset property, and blocking property were excellent. Also, as to the image characteristics, vivid images without fogging were obtained. Further, as to the built-up chargeability, it was largely charged to plus and the amount of the charges was preferably stabilized in 3 minutes.

EXAMPLE 9

A binder resin for toners was obtained under the same conditions as in Example 1 except that 30 parts by weight of the resin 4 obtained in Preparation Example and 70 parts by weight of the resin 9 obtained in Preparation Example 9 were used. The binder resin for toners thus obtained had a glass transition temperature of 53° C., softening temperature of 132° C., acid value of 2.7 mg KOH/g, and $AV^H/AV^L$ of 1.32. Also, two peaks existed in a high molecular weight region and low molecular weight region in the molecular weight distribution by gel permeation chromatography, the weight average molecular weight in the high molecular weight region was $6.8\times10^5$, and the weight average molecular weight in the low molecular region was $8.7\times10^3$. Further, the amount of the residual monomers was about 800 ppm.

The binder resin for toners was made into a toner by the same method as in Example 1 and evaluated for its toner characteristics by the same method as in Example 1 by using a copying machine for a plus charge. As a result, the fixing property and anti-offset property were excellent. As to the blocking resistance, a blocking phenomenon was slightly observed, but it was of such an extent that the toner caused practically no problem. Also, as to the image characteristics, vivid images without fogging were obtained. Further, as to the built-up chargeability, it was largely charged to plus and the amount of the charges was preferably stabilized in 6 minutes.

EXAMPLE 10

A binder resin for toners was obtained under the same conditions as in Example 1 except that 30 parts by weight of the resin 4 obtained in Preparation Example 4 and 70 parts by weight of the resin 10 obtained in Preparation Example 10 were used. The binder resin for toners thus obtained had a glass transition temperature of 62° C., softening temperature of 142° C., acid value of 2.1 mg KOH/g, and $AV^H/AV^L$ of 1.57. Also, two peaks existed in a high molecular weight region and low molecular weight region in the molecular weight distribution by gel permeation chromatography, the weight average molecular weight in the high molecular weight region was $6.8\times10^5$, and the weight average molecular weight in the low molecular region was $5.6\times10^4$. Further, the amount of the residual monomers was about 100 ppm.

The binder resin for toners was made into a toner by the same method as in Example 1 and evaluated for its toner characteristics by the same method as in Example 1 by using a copying machine for a plus charge. As a result, the anti-offset offset property and blocking resistance were excellent. While the fixing property was slightly inferior, it was of such an extent that the toner caused practically no problem. Also, as to the image characteristics, vivid images without fogging were obtained. Further, as to the built-up chargeability, it was largely charged to plus and the amount of the charges was preferably stabilized in 3 minutes.

Comparative Example 1

A binder resin for toners was obtained under the same conditions as in Example 1 except that 30 parts by weight of the resin 13 obtained in Preparation Example 13 and 70 parts by weight of the resin 14 obtained in Preparation Example 14 were used. The binder resin for toners thus obtained had a glass transition temperature of 43° C., softening temperature of 132° C., acid value of 26.1 mg KOH/g, and $AV^H/AV^L$ of 1.00. Also, two peaks existed in a high molecular weight region and low molecular weight region in the molecular weight distribution by gel permeation chromatography, the weight average molecular weight in the high molecular weight region was $6.8\times10^5$, and the weight average molecular weight in the low molecular region was $9.1\times10^3$. Further, the amount of the residual monomers was less than 50 ppm.

The binder resin for toners was made into a toner by the same method as in Example 1 and evaluated for its toner characteristics by the same method as in Example 1 by using a copying machine for a minus charge. As a result, the fixing property and anti-offset property were excellent. The blocking resistance was poor and many blocking phenomena were observed. As to the image characteristics, fogging slightly occurred, but it was of such an extent that the toner caused practically no problem. Further, as to the built-up chargeability, it was weak both in plus and minus, and the amount of the charges was unpreferably not stabilized and continued to increase.

Comparative Example 2

A binder resin for toners was obtained under the same conditions as in Example 1 except that 30 parts by weight of the resin 13 obtained in Preparation Example 13 and 70 parts by weight of the resin 12 obtained in Preparation Example 12 were used. The binder resin for toners thus obtained had a glass transition temperature of 54° C., softening temperature of 133° C., acid value of 8.3 mg KOH/g, and $AV^H/AV^L$ of 53.0. Also, two peaks existed in a high the molecular weight region and low molecular weight region in the molecular weight distribution by gel permeation chromatography, the weight average molecular weight in the high molecular weight region was $6.8\times10^6$, and the weight average molecular weight in the low molecular region was $8.8\times10^3$. Further, the amount of the residual monomers was less than 50 ppm.

The binder resin for a toner was made into a toner by the same method as in Example 1 and evaluated for its toner characteristics by the same method as in Example 1 by using a copying machine for a plus charge and for a minus charge. As a result, the fixing property, anti-offset property, and blocking resistance were excellent. As to the image characteristics, fogging slightly occurred, but it was of such an extent that the toner caused practically no problem. On the other hand, as to the built-up chargeability, it was weak both in plus and minus, and the amount of the charges was unpreferably not stabilized and continued to increase.

Comparative Example 3

A binder resin for toners was obtained under the same conditions as in Example 1 except that 30 parts by weight of the resin 11 obtained in Preparation Example 11 and 70 parts by weight of the resin 14 obtained in Preparation Example 14 were used. The binder resin for toners thus obtained had a glass transition temperature of 60° C., softening temperature of 135° C., acid value of 18.6 mg KOH/g, and $AV^H/AV^L$ of 0.02. Also, two peaks existed in a high molecular weight region and low molecular weight region in the molecular weight distribution by gel permeation chromatography, the weight average molecular weight in the high molecular weight region was $6.8\times10^5$, and the weight average molecular weight in the low molecular region was $9\times10^3$. Further, the amount of the residual monomers was less than 50 ppm.

The binder resin for toners was made into a toner by the same method as in Example 1 and evaluated for its toner characteristics by the same method as in Example 1 by using a copying machine for a plus charge and that for a minus charge. As a result, the fixing property, anti-offset property, and blocking resistance were excellent. As to the image characteristics, fogging slightly occurred, but it was of such an extent that the toner caused practically no problem. On the other hand, as to the built-up chargeability, it was weak both in plus and minus, and the amount of the charges was unpreferably not stabilized and continued to increase.

Comparative Example 4

A binder resin for toners was obtained under the same conditions as in Example 1 except that 5 parts by weight of the resin 3 obtained in Preparation Example 3 and 95 parts by weight of the resin 6 obtained in Preparation Example 6 were used. The binder resin for toners thus obtained had a glass transition temperature of 48° C., softening temperature of 105° C., acid value of 3.7 mg KOH/g, and $AV^H/AV^L$ of 6.48. Also, two peaks existed in a high molecular weight region and low molecular weight region in the molecular weight distribution by gel permeation chromatography, the weight average molecular weight in the high molecular weight region was $9\times10^5$, and the weight average molecular weight in the low molecular region was $4.6\times10^5$. Further, the amount of the residual monomers was less than 50 ppm.

The binder resin for a toner was made into a toner by the same method as in Example 1 and evaluated for its toner characteristics by the same method as in Example 1 by using a copying machine for a minus charge. As a result, the fixing property was excellent, but the anti-offset property was inferior. The blocking resistance was poor and many blocking phenomena were observed. As to the image characteristics, vivid images were obtained without fogging. As to the built-up chargeability, it was largely charged to minus, and the amount of the charges was preferably stabilized in 7 minutes.

Comparative Example 5

A binder resin for toners was obtained under the same conditions as in Example 1 except that 50 parts by weight of the resin 3 obtained in Preparation Example 3 and 50 parts by weight of the resin 6 obtained in Preparation Example 6 were used. The binder resin for toners thus obtained had a glass transition temperature of 64° C., softening temperature of 148° C., acid value of 10.9 mg KOH/g, and $AV^H/AV^L$ of 6.48. Also, two peaks existed in a high molecular weight region and low molecular weight region in the molecular weight distribution by gel permeation chromatography, the weight average molecular weight in the high molecular weight region was $9\times10^5$, and the weight average molecular weight in the low molecular region Was $4.6\times10^5$. Further, the amount of the residual monomers was less than 50 ppm.

The binder resin for toners was made into a toner by the same method as in Example 1 and evaluated for its toner characteristics by the same method as in Example 1 by using a copying machine for a minus charge. As a result, the anti-offset property and blocking resistance were excellent, but the fixing property was inferior. As to the image characteristics, vivid images were obtained without fogging. As to the built-up chargeability, it was largely charged to minus, and the amount of the charges was preferably stabilized in 7 minutes.

Comparative Example 6

A binder resin for toners was obtained under the same conditions as in Example 1 except that 30 parts by weight of the resin 15 obtained in Preparation Example 15 and 70 parts by weight of the resin 16 obtained in Preparation Example 16 were used. The binder resin for toners thus obtained had a glass transition temperature of 48° C., softening temperature of 129° C., acid value of 2.7 mg KOH/g, and $AV^H/AV^L$ of 1.32. Also, two peaks existed in a high molecular weight region and low molecular weight region in the molecular weight distribution by gel permeation chromatography, the weight average molecular weight in the high molecular weight region was $6.8\times10^5$, and the weight average molecular weight in the low molecular region was $8.7\times10^3$. Further, the amount of the residual monomers was about 1300 ppm.

The binder resin for toners was made into a toner by the same method as in Example 1 and evaluated for its toner characteristics by the same method as in Example 1 by using a copying machine for a plus charge. As a result, the fixing property and anti-offset property were excellent, but the blocking resistance was inferior and many blocking phenomena were observed. As to the image characteristics, vivid images were obtained without fogging. As to the built-up chargeability, it was largely charged to plus, and the amount of the charges was preferably stabilized in 8 minutes.

As described above, when the binder resin for toners in Examples 1 through 10 of the present invention was used, the balance between the fixing property and anti-offset property can be made excellent by controlling the contents of the high molecular weight polymer and low molecular weight polymer; the built-up chargeability can be improved by controlling the acid value and ratio of the high molecular weight polymer and low molecular weight polymer; and vivid images without fogging can be obtained by controlling the residual monomers in the resin to less than a certain amount. Also, the fixing property can be made excellent by adjusting the softening temperature in a certain range, and the blocking resistance can be made excellent by adjusting the glass transition temperature in a certain range.

[Examples and comparative examples of second aspect of invention]

EXAMPLE 11

In a reaction vessel provided with a distillation column, stirrer, and thermometer was placed 1400 parts by weight of an emulsion of a weight ratio of styrene to n-butyl acrylate of 85: 15, a solid content of 14.3%, and a weight average molecular weight of 1000000, stirred at a speed of stirring of 100 rpm. A solution of 6.4 parts by weight of a polyvinyl alcohol and 8 parts by weight of sodium sulfate dissolved in 800 parts by weight of deionized water was added. Then, 696 parts by weight of styrene, 104 parts by weight of an acrylic ester, and 16 parts by weight of alphamethylstyrene dimer were added into the reaction vessel, and stirring for mixing was conducted for about 1 hour at a rotating speed of 300 rpm at an internal temperature of the vessel of 40° C. Thereafter, 16 parts by weight of benzoil peroxide was added in the reaction vessel, the internal temperature of the vessel was increased up to 90° C., and suspension polymerization was conducted for about 3 hours. After completion of the suspension polymerization, a Liebig cooling tube was provided, a silicone type defoaming agent (KM-70, manufactured by Shin-Etsu Chemical Co., Ltd.) was added, the internal temperature of the vessel was increased up to 90° C., and the residual monomers were separated. Thereafter, the internal temperature of the vessel was cooled down to 100° C., 16 parts by weight of a caustic soda was added, and the mixture was kept for about 30 minutes. Further, after the inside of the reaction system was cooled down to room temperature, the resin was taken out and dried at 50° C. for about 12 hours.

The resin thus obtained had an acid value of 1.5 mg KOH/g, a melt viscosity of $1.8\times10^4$ Pa.S at 120° C., and a glass transition temperature of 64.5° C. Also, it had a maximum value at the position of a molecular weight of $8.5\times10^5$ in the molecular weight distribution by gel permeation chromatography. This peak was the greatest molecular weight. It also had a shoulder at the position of the molecular weight of $1.39\times10^6$ in the distribution. Further, it had a maximum value at the position of molecular weight of $1.6\times10^4$.

Then, 91 parts by weight of the resin thus obtained, 5 parts by weight of a carbon black, 1 part by weight of a charge controlling agent (Bontron S-34, manufactured by Orient Chemical Co., Ltd.), and 3 parts by weight of a low molecular weight polypropylene wax were mixed with a Henschel mixer and kneaded in a twin-screw extruder under the condition of 130° C. Thereafter, pulverization and classification were repeated until the particle size became 10 to 20 μm, to obtain a toner. The toner thus obtained was excellent in the fixing property, anti-offset property, and blocking resistance. Images had no fogging and new vivid, and the image characteristics were also excellent.

The fixing property and anti-offset property were evaluated by using a copying machine with a varied copying speed. The copying speed was set at 70 sheets/min. The image characteristics were evaluated from the occurrence of fogging after 5000 copies using a similar copying machine. The blocking resistance was evaluated by placing 50 g of a toner in a sample bottle, placing it in a hot air dryer kept at 50° C., leaving it as is for about 48 hours, and observing the coagulation state of the toner when the sample bottle was turned upside down.

EXAMPLE 12

In a reaction vessel was placed a solution in which 1752 parts by weight of an emulsion, 750 parts by weight of deionized water, 6 parts by weight of a polyvinyl alcohol, and 7.5 parts by weight of sodium sulfate were dissolved. The emulsion had a weight ratio of styrene to n-butyl acrylate of 65: 35, solid content of 14.3%, and a weight average molecular weight of 590000. Then, 645 parts by weight of styrene, 97.5 parts by weight of ethyl acrylate, 7.5 parts by weight of methacrylic acid, 15 parts by weight of alpha-methylstyrene dimer, and 60 parts by weight of benzoil peroxide were added into the reaction vessel, and suspension polymerization was conducted in the same way as in Example 11.

The resin thus obtained had an acid value of 5.3 mg KOH/g, a melt viscosity of $3.0\times10^4$ Pa.S at 120° C., and a glass transition temperature of 62.0° C. Also, it had a maximum value at the position of a molecular weight of $4.8\times10^5$ in the molecular weight distribution by gel permeation chromatography. This peak was the greatest molecular weight. It also had a shoulder at the position of a molecular weight of $7.0\times10^5$ in the distribution. Further, it had a maximum value at the position of a molecular weight of $1.58\times10^4$.

Then, the resin thus obtained was made into a toner by the same method as in Example 11 and was evaluated for toner performances by the same method as in Example 11. The toner thus obtained was excellent in the fixing property, anti-offset property, and blocking resistance. Particularly, the balance between the fixing property and anti-offset property was excellent. Further, images were vivid without fogging and image characteristics were also excellent.

EXAMPLE 13

In a reaction vessel was placed a solution in which 1960 parts by weight of an emulsion, 720 parts by weight of deionized water, 5.8 parts by weight of a polyvinyl alcohol, and 7.2 parts by weight of sodium sulfate were dissolved. The emulsion had a weight ratio of styrene to n-butyl acrylate of 85: 15, solid Content of 14.3%, and a weight average molecular weight of $1.2\times10^6$. Then, 590 parts by weight of styrene, 108 parts by weight of ethyl acrylate, 21.6 parts by weight of methacrylic acid, 14.4 parts by weight of alpha-methylstyrene dimer, and 57.6 parts by weight of benzoil peroxide were added into the reaction vessel, and suspension polymerization was conducted in the same way as in Example 11.

The resin thus obtained had an acid value of 18.3 mg KOH/g, a melt viscosity of $4.0\times10^4$ Pa.S at 120° C., and a glass transition temperature of 66.0° C. Also, it had a maximum value at the position of a molecular weight of $1.0\times10^6$, in the molecular weight distribution by gel permeation chromatography. This peak was the greatest molecular weight. It also had a shoulder at the position of a molecular weight of $1.5\times10^6$ in the distribution. Further, it had a maximum value at the position of a molecular weight of $1.88\times10^4$.

Then, the resin thus obtained was made into a toner by the same method as in Example 11 and was evaluated for toner performances by the same method as in Example 11. The toner thus obtained was excellent in the fixing property, anti-offset property, and blocking resistance, the images were vivid without fogging, and the image characteristics were also excellent.

EXAMPLE 14

In a reaction vessel was placed a solution of 1050 parts by weight of the emulsion used in Example 12,850 parts by weight of deionized water, 6.8 parts by weight of a polyvinyl alcohol, and 8.5 parts by weight of sodium sulfate. Then, 722 parts by weight of styrene, 128 parts by weight of n-butyl acrylate, 12.8 parts by weight of alpha-methylstyrene dimer, and 2.5 parts by weight of benzoil peroxide were added into the reaction vessel, and suspension polymerization was conducted in the same way as in Example 11.

The resin thus obtained had an acid value of 1.0 mg KOH/g, a melt viscosity of $2.1\times10^4$ Pa.S at 120° C., and a glass transition temperature of 61.0° C. Also, it had a maximum value at the position of a molecular weight of $4.8\times10^5$ in the molecular weight distribution by gel permeation chromatography. This peak was the greatest molecular weight. If also had a shoulder at the position of a molecular weight of $7.0\times10^5$ in the distribution. Further, it had a maximum value at the position of a molecular weight of $3.28\times10^4$.

Then, the resin thus obtained was made into a toner by the same method as in Example 11 and was evaluated for toner performances by the same method as in Example 11. The toner thus obtained was excellent in the fixing property, anti-offset property, and blocking resistance. Particularly, the balance between the fixing property and anti-offset property was excellent. Further, images were vivid without and the image characteristics were also excellent.

EXAMPLE 15

Styrene in an amount of 240 parts by weight, 60 parts by weight of n-butyl acrylate, and 0.3 part by weight of 2,2-bis(4,4-di-t-butylperoxycyclohexyl)propane were mixed, the mixture was placed in a reaction vessel provided with a distillation column, stirrer, and thermometer; nitrogen gas substitution was carried out for 1 hour, and the internal temperature of the vessel was raised up to 92° C. while maintaining the rotating speed at 50 rpm and flowing nitrogen gas to polymerize up to 70% of the vinyl polymer by bulk polymerization; 457 parts by weight of xylene was added; and then the internal temperature of the vessel was increased up to 140° C. Then, a mixture of 68 parts by weight of xylene, 312 parts by weight of styrene, 80 parts by weight of n-butyl acrylate, 8 parts by weight of methacrylic acid, 9.8 parts by weight of alpha-methylstyrene dimer, and 29.4 parts by weight of azobisisobutyronitrile was added dropwise over about 6 hours to perform a solution polymerization. After completion of the solution polymerization, the xylene was separated under a high vacuum of lower than 50 mmHg, and it was cooled when the solvent separation was completed to obtain a solid resin.

The resin thus obtained had an acid value of 8.4 mg KOH/g, a melt viscosity of $8.0\times10^3$ Pa.S at 120° C., and a glass transition temperature of 58.0° C. Also, it had a maximum value at the position of a molecular weight of $5.8\times10^5$ in the molecular weight distribution by gel permeation chromatography. This peak was the greatest molecular weight. It also had a shoulder at the position of a molecular weight of $1.35\times10^5$ in the distribution. Further, it had a maximum value at the position of a molecular weight of $4.0\times10^3$.

Then, the resin thus obtained was made into a toner by the same method as in Example 11 and was evaluated for toner performances by the same method as in Example 11. The toner thus obtained was excellent in the fixing property, anti-offset property, and blocking resistance, and images were vivid without fogging, and image characteristics were also excellent.

EXAMPLE 16

A copolymer having a weight ratio of styrene, n-butyl acrylate, and methacrylic acid of 78:20:2 and having a weight average molecular weight of $8.0\times10^5$ in an amount of 5 parts by weight; having a weight average molecular weight of $7.0\times10^6$ in an amount of 20 parts by weight; and 70 parts by weight of a copolymer having a weight ratio of styrene to n-butyl acrylate of 78:12 and a weight average molecular weight of $6.0\times10^6$ were mixed to obtain a solid resin.

The resin thus obtained had an acid value of 3.2 mg KOH/g, a melt viscosity of $8.0\times10^4$ Pa.S at 120° C., and a glass transition temperature of 55.0° C. Also, it had a maximum value at the position of a molecular weight of $5.8\times10^6$, in the molecular weight distribution by gel permeation chromatography. This peak was the greatest molecular weight. It also had a shoulder at the position of a molecular weight of $8.0\times10^5$ in the distribution. Further, it had a maximum value at the position of a molecular weight of $5.8\times10^4$.

Then, the resin thus obtained was made into a toner by the same method as in Example 11 and was evaluated for toner performances by the same method as in Example 11. The toner thus obtained was excellent in the fixing property, anti-offset property, and blocking resistance. Particularly, the balance between the fixing property and anti-offset property was excellent. Further, images were vivid without fogging, and image characteristics were also excellent.

Comparative Example 7

A solid resin was obtained in the same method as in Example 11 except that an emulsion having a weight ratio of styrene to n-butyl acrylate of 80:20 and a weight average molecular weight of $4.0\times10^5$ was used.

The resin thus obtained had an acid value of 1.2 mg KOH/g, a melt viscosity of $1.0\times10^4$ Pa.S at 120° C., and a glass transition temperature of 63.5° C. Also, it had a maximum value at the position of a molecular weight of $3.0\times10^5$ in the molecular weight distribution by gel permeation chromatography. This peak was the greatest molecular weight. It also had a shoulder at the position of a molecular weight of $4.0\times10^5$ in the distribution. Further, it had a maximum value at the position of a molecular weight of $1.2\times10^4$.

Then, the resin thus obtained was made into a toner by the same method as in Example 11 and was evaluated for toner performances by the same method as in Example 11. The toner thus obtained was excellent in the fixing property, blocking resistance, and image characteristics, but poor in the anti-offset property.

Comparative Example 8

A solid resin was obtained by the same method as in Example 12 except that an emulsion having a weight ratio of styrene to n-butyl acrylate of 80:20 and a weight average molecular weight of $2.6\times10^6$ was used.

The resin thus obtained had an acid value of 3.5 mg KOH/g, a melt viscosity of $1.0\times10^5$ Pa.S at 120° C., and a glass transition temperature of 70.0° C. Also, it had a maximum value at the position of a molecular weight of $2.45\times10^6$ in the molecular weight distribution by gel permeation chromatography. This peak was the greatest molecular weight. It also had a shoulder at the position of a molecular weight of $2.6\times10^6$ in the distribution. Further, it had a maximum value at the position of a molecular weight of $1.68\times10^4$.

Then, the resin thus obtained was made into a toner by the same method as in Example 11 and was evaluated for toner performances by the same method as in Example 11. The toner thus obtained was excellent in the anti-offset property, blocking resistance, the image characteristics were excellent, but the fixing property was poor.

Comparative Example 9

A solid resin was obtained by the same method as in Example 12 except that 276.5 parts by weight of the emulsion in Example 12 was used.

The resin thus obtained had an acid value of 5.8 mg KOH/g, a melt viscosity of $2.0\times10^3$ Pa.S at 120° C., and a glass transition temperature of 56.0° C. Also, it had a maximum value at a position of a molecular weight of $4.8\times10^5$ in the molecular weight distribution by gel permeation chromatography. This peak was the greatest molecular weight. It had no shoulder. Further, it had a maximum value at the position of a molecular weight of $1.8\times10^4$.

Then, the resin thus obtained was made into a toner by the same method as in Example 11 and was evaluated for toner performances by the same method as in Example 11. The toner thus obtained was excellent in the fixing property and blocking resistance, but inferior in the anti-offset property. Images had fogging, and vivid images were not obtained.

Comparative Example 10

A suspension polymerization was carried out by the same method as in Example 11 except that 1752 parts by weight of an emulsion having a weight ratio of styrene to n-butyl acrylate of 70:30 and a weight average molecular weight of $1.61\times10^6$, 525 parts by weight of styrene, and 225 parts by weight of n-butyl acrylate were used.

The resin thus obtained had an acid value of 1.5 mg KOH/g, a melt viscosity of $2.1\times10^4$ Pa.S at 120° C., and a glass transition temperature of 41.5° C. Also, it had a maximum value at the position of a molecular weight of $1.42\times10^6$ in the molecular weight distribution by gel permeation chromatography. This peak was the greatest molecular weight. It also had a shoulder at the position of a molecular weight of $1.6\times10^6$ in the distribution. Further, it had a maximum value at the position of a molecular weight of $1.48\times10^4$.

Then, the resin thus obtained was made into a toner by the same method as in Example 11 and was evaluated for toner performances by the same method as in Example 11. The toner thus obtained was excellent in the fixing property, anti-offset property, and image characteristics, but inferior in the blocking resistance.

As described above, the binder resin for toners of the second aspect of the present invention can provide toners having a remarkably excellent fixing property, anti-offset property, blocking resistance, and image characteristics, and makes higher speeds of copying machines and printers possible through the control of the molecular weight, viscosity, acid value, and glass transition temperature.

[Examples and comparative examples of third aspect of invention]

EXAMPLE 17

In a reaction vessel provided with a thermometer, stirrer, and distillation column were placed 1200 parts by weight of deionized water and 0.02 part by weight of an emulsifier which was a copolymer of methyl methacrylate with 3-sodium sulfopropyl methacrylate. Then, 172 parts by weight of styrene, 2.8 parts by weight of n-butyl acrylate, and 0.4 parts by weight of potassium persulfate were added in the vessel. Thereafter, nitrogen gas was introduced into the reaction vessel, nitrogen gas substitution was carried out for about 1 hour, the rotating speed was maintained at 170 rpm while flowing nitrogen gas, the temperature of the reaction system was raised up to about 72° C., and emulsion polymerization was performed for about 4 hours.

Then, the temperature of the reaction system was decreased down to about 40° C.; a mixture of 800 parts by weight of deionized water, 4 parts by weight of a polyvinyl alcohol, and 4 parts by weight of sodium sulfate was added; 760 parts by weight of styrene, 40 parts by weight of n-butyl acrylate, and 16 parts by weight of alpha-methylstyrene dimer were further added; and impregnation was carried out for 1 hour. Thereafter, 64 parts by weight of benzoil peroxide was added, the temperature of the reaction system was increased up to 130° C. In about 30 minutes, suspension polymerization was carried out for about 2 hours, the temperature of the reaction system was increased up to 140° C., and heat treatment was performed for about 2 hours.

Further, 4 parts by weight of a defoaming agent was added, the reaction system was brought to 100° C., residual monomers were discharged, the temperature of the reaction system was cooled down to 90° C., 1 part by weight of a caustic soda was added, and alkali treatment was conducted for about 30 minutes. Thereafter, the temperature was decreased down to room temperature, a resin was taken out, and the resin was sufficiently washed with deionized water and thoroughly dried at 50° C.

The resin thus obtained had a softening temperature of 128° C., glass transition temperature of 62° C., and acid value of 0.5 mg KOH/g, and had a maximum value at the position of a molecular weight of $1\times10^6$ and $7.5\times10^3$. Also, a shoulder existed at the position of a molecular weight of $2.5\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd. ) were melted and kneaded at 130° C. by using a mixer. After having been cooled, it was pulverized and classified to obtain a toner having an average particle size of 15 m. The toner thus obtained was excellent in the anti-offset property, image characteristics, and blocking resistance. The fixing property was slightly inferior, but it was of such an extent that the toner could practically be used.

The fixing property, anti-offset property, and image characteristics were evaluated by using a copying machine with silicone oil rollers and with a variable copying speed and temperature. This set was to a printing speed of 400 mm/sec. The blocking resistance was evaluated from the coagulation state of the toner when 1 g of toner was placed in a hot air dryer kept at 50° C. and left there for 50 hours.

Evaluation criteria:

Fixing property: Decided using 150° C. as a criterion

Anti-offset property: Decided using 220° C. as a criterion

Image characteristics: Decided from image stability and image fogging

EXAMPLE 18

Emulsion polymerization was carried out under the same conditions as in Example 17 except that 2100 parts by weight of deionized water, 0.035 part by weight of an emulsifier, 301 parts by weight of styrene, 49 parts by weight of n-butyl acrylate, and 1.1 parts by weight of potassium persulfate were used and the polymerization temperature was set at 80° C. Then, suspension polymerization was conducted under the same conditions as in Example 17 except that 650 parts by weight of deionized water, 3.25 parts by weight of a polyvinyl alcohol, 3.25 parts by weight of sodium sulfate, 617 parts by weight of styrene, 33 parts by weight of n-butyl acrylate, 13 parts by weight of alpha-methylstyrene dimer, 52 parts by weight of benzoil peroxide, and 5.2 parts by weight of t-butylperoxybenzoate were used and the polymerization temperature was set at 140° C. Further, treatment for residual monomers and an alkali treatment were conducted under the same conditions as in Example 17 except that the heat treatment temperature was set at 145° C.

The resin thus obtained had a softening temperature of 134° C., glass transition temperature of 60° C., and acid value of 0.8 mg KOH/g, and had a maximum value at the position of a molecular weight of $5.45\times10^5$ and $6.5\times10^3$. Also, a shoulder existed at the position of a molecular weight of $1.2\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 140° C. by using a mixer. After having been cooled, it was pulverized and classified to obtain a toner having an average particle size of 15 μm. The toner thus obtained was evaluated by the same methods as in Example 17 to find that all of the fixing property, anti-offset property, image characteristics, and blocking resistance were excellent.

EXAMPLE 19

An emulsion polymerization was carried out under the same conditions as in Example 17 except that 2100 parts by weight of deionized water, 0.035 part by weight of an emulsifier, 280 parts by weight of styrene, 70 parts by weight of n-butyl acrylate, and 1.7 parts by weight of potassium persulfate were used and the polymerization temperature was set at 80° C. Then, suspension polymerization was conducted under the same conditions as in Example 17 except that 650 parts by weight of deionized water, 3.25 parts by weight of a polyvinyl alcohol, 3.25 parts by weight of sodium sulfate, 585 parts by weight of styrene, 65 parts by weight of n-butyl acrylate, 16.25 parts by weight of alpha-methylstyrene dimer, 59 parts by weight of benzoil peroxide, and 7.5 parts by weight of t-butylperoxybenzoate were used. Further, treatment for residual monomers and an alkali treatment were conducted under the same conditions as in Example 17.

The resin thus obtained had a softening temperature of 130° C., glass transition temperature of 56° C., and acid value of 1.0 mg KOH/g, and had a maximum value at the position of a molecular weight of $3.8\times10^5$ and $4\times10^3$. Also, a shoulder existed at a molecular weight of $1\times10^5$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 140° C. by using a mixer. After having been cooled, it was pulverized and classified to obtain a toner having an average particle size of 15 μm. The toner thus obtained was evaluated by the same methods as in Example 17 to find that all of the fixing property, image characteristics, and blocking resistance were excellent, and that the anti-offset property was slightly inferior but it was of such an extent that the toner could practically be used.

EXAMPLE 20

Emulsion polymerization was carried out using the same composition under the same conditions as in Example 18, then suspension polymerization was conducted under the same conditions as in Example 17 except that 650 parts by weight of deionized water, 3.25 parts by weight of a polyvinyl alcohol, 3.25 parts by weight of sodium sulfate, 555 parts by weight of styrene, 29 parts by weight of n-butyl acrylate, 12 parts by weight of alpha-methylstyrene dimer, 47 parts by weight of benzoil peroxide, 4.7 parts by weight of t-butylperoxybenzoate, 65 parts by weight of a polymer which was prepared by polymerizing styrene and n-butyl acrylate at a weight ratio of 95:5 and having a weight average molecular weight of $3\times10^3$ were used and the polymerization temperature was set at 140° C. Further, treatment for residual monomers and an alkali treatment were conducted under the same conditions in Example 17 except that the temperature of the heat treatment was set at 145° C.

The resin thus obtained had a softening temperature of 134° C., glass transition temperature of 53° C., and acid value of 0.8 mg KOH/g, and had a maximum value at the position of a molecular weight of $5.4\times10^4$ and $6\times10^3$. Also, a shoulder existed at the position of a molecular weight of $1.2\times10^5$ and $8\times10^2$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 140° C. by using a mixer. After having been cooled, it was pulverized and classified to obtain a toner having an average particle size of 15 μm. The toner thus obtained was evaluated by the same methods as in Example 17 to find that the fixing property, anti-offset property, and image characteristics were excellent, and that the blocking resistance was slightly inferior but it was of such an extent that the toner could practically be used.

EXAMPLE 21

Emulsion polymerization was carried out under the same conditions as in Example 17 except that 2100 parts by weight of deionized water, 0.035 part by weight of an emulsifier, 267.7 parts by weight of styrene, 70 parts by weight of n-butyl acrylate, 12.3 parts by weight of methacrylic acid, and 1.7 parts by weight of potassium persulfate were used and the polymerization temperature was set at 80° C. Then, suspension polymerization was conducted under the same conditions as in Example 17 except that 650 parts by weight of deionized water, 3.25 parts by weight of a polyvinyl alcohol, 3.25 parts by weight of sodium sulfate, 562.2 parts by weight of styrene, 65 parts by weight of n-butyl acrylate, 22.8 parts by weight of methacrylic acid, 13 parts by weight of alpha-methylstyrene dimer, 59 parts by weight of benzoil peroxide, and 7.5 parts by weight of t-butylperoxybenzoate were used. Further, treatment for residual monomers and an alkali treatment were conducted under the same conditions in Example 17 to obtain a resin.

The resin thus obtained had a softening temperature of 140° C., glass transition temperature of 60° C., and acid value of 23.5 mg KOH/g, and had a maximum value at the position of a molecular weight of $3.9\times10^5$ and $4.1\times10^3$. Also, a shoulder existed at a molecular weight of $1.1\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 145° C. by using a mixer. After having been cooled, it was pulverized and classified to obtain a toner having an average particle size of 15 μm. The toner thus obtained was evaluated by the same methods as in Example 17 to find that the fixing property, image characteristics, and blocking resistance were excellent, and that the anti-offset property was slightly inferior but it was of such an extent that the toner could practically be used.

EXAMPLE 22

Emulsion polymerization was carried out under the same conditions as in Example 17 except that 2100 parts by weight of deionized water, 0.035 part by weight of an emulsifier, 259 parts by weight of styrene, 70 parts by weight of n-butyl acrylate, 21 parts by weight of methacrylaic acid, and 1.7 parts by weight of potassium persulfate were used and the polymerization temperature was set at 80° C. Then, suspension polymerization was conducted under the same conditions as in Example 17 except that 650 parts by weight of deionized water, 3.25 parts by weight of a polyvinyl alcohol, 3.25 parts by weight of sodium sulfate, 546 parts by weight of styrene, 65 parts by weight of n-butyl acrylate, 39 parts by weight of methacrylic acid, 13 parts by weight of alpha-methylstyrene dimer, 59 parts by weight of benzoil peroxide, and 7.5 parts by weight of t-butylperoxybenzoate were used. Further, treatment for residual monomers and an alkali treatment were conducted under the same conditions in Example 17 to obtain a resin.

The resin thus obtained had a softening temperature of 148° C., glass transition temperature of 66° C., and acid value of 38.5 mg KOH/g, and had a maximum value at the position of molecular weight of $3.9\times10^5$ and $4\times10^3$. Also, a shoulder existed at the position of a molecular weight of $1\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 150° C. by using a mixer. After having been cooled, it was pulverized and classified to obtain a toner having an average particle size of 15 μm. The toner thus obtained was evaluated by the same methods as in Example 17 to find that the blocking resistance was excellent, and that the fixing property, anti-offset property and image characteristics were slightly inferior but they were of such an extent that the toner could practically be used.

EXAMPLE 23

Emulsion polymerization was carried out under the same conditions as in Example 17 except that 2100 parts by weight of deionized water, 0.035 part by weight of an emulsifier, 301 parts by weight of styrene, 9 parts by weight of n-butyl acrylate, and 1.1 parts by weight of potassium persulfate were used and the polymerization temperature was set at 80° C. Then, suspension polymerization was conducted under the same conditions as in Example 17 except that 650 parts by weight of deionized water, 3.25 parts by weight of a polyvinyl alcohol, 3.25 parts by weight of sodium sulfate, 617 parts by weight of styrene, 33 parts by weight of n-butyl acrylate, 3.25 parts by weight of alpha-methylstyrene dimer, 19.5 parts by weight of benzoil peroxide, and 5.2 parts by weight of t-butylperoxybenzoate were used, and the polymerization temperature was set at 110° C. Further, treatment for residual monomers and an alkali treatment were conducted under the same conditions as in Example 1 except that the temperature for the heat treatment was set at 140° C. to obtain a resin.

The resin thus obtained had a softening temperature of 140° C., glass transition temperature of 60° C., and acid value of 0.8 mg KOH/g, and had a maxim value at the position of molecular weight of $5.45\times10^5$ and $5.5\times10^4$. Also, a shoulder existed at the position of a molecular weight of $1.2\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 145° C. by using a mixer. After having been cooled, it was pulverized and classified to obtain a toner having an average particle size of 15 μm. The toner thus obtained was evaluated by the same methods as in Example 17 to find that the anti-offset property, image characteristics, and blocking resistance were excellent, and that the fixing property was slightly inferior but it was of such an extent that the toner could practically be used.

Comparative Example 11

Emulsion polymerization was conducted under the same conditions as in Example 17 except that the amount of potassium persulfate was changed to 0.3 part by weight and polymerization was conducted at 65° C. for about 8 hours, then suspension polymerization was conducted using the same composition under the same conditions as in Example 17. Further, heat treatment was conducted under the same conditions as in Example 17 to obtain a resin.

The resin thus obtained had a softening temperature of 135° C., glass transition temperature of 62° C., and acid value of 0.5 mg KOH/g, and had a maximum value at the position of a molecular weight of $2.5\times10^6$ and $7.5\times10^5$. Also, a shoulder existed at the position of a molecular weight of $2.5\times10^5$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 140° C. by using a mixer. After having been cooled, it was pulverized and classified to obtain a toner having an average particle size of 15 μm. The toner thus obtained was evaluated by the same methods as in Example 17 to find that the anti-offset property, image characteristics, and blocking resistance were excellent, but the fixing property was so poor that the toner was practically unusable.

Comparative Example 12

Emulsion polymerization was conducted using the same composition under the same conditions as in Example 17. Thereafter, suspension polymerization was conducted using the same conditions as in Example 17 except that the amount of alpha-methylstyrene and benzoil peroxide were changed to 0.8 and 8 parts by weight, respectively, and the polymerization was conducted at 80° C. for about 5 hours. Further, treatment for residual monomers and an alkali treatment were conducted under the same conditions as in Example 17 except that the heat treatment temperature was set at 140° C. to obtain a resin.

The resin thus obtained had a softening temperature of 152° C., glass transition temperature of 62° C., and acid value of 0.5 mg KOH/g, and had a maximum value at the position of a molecular weight of $1\times10^6$ and $7\times10^4$. Also, a shoulder existed at the position of a molecular weight of $2.5\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 140° C. by using a mixer. After having been cooled, it was pulverized and classified to obtain a toner having an average particle size of 15 μm. The toner thus obtained was evaluated by the same methods as in Example 17 to find that the anti-offset property, image characteristics, and blocking resistance were excellent, but the fixing property was so poor that the toner was practically unusable.

Comparative Example 13

Emulsion polymerization and suspension polymerization were conducted using the same compositions under the same conditions as in Example 17. Further, treatment for residual monomers by distillation and an alkali treatment were conducted under the same conditions as in Example 17 to obtain a resin.

The resin thus obtained had a softening temperature of 130° C., glass transition temperature of 62° C., and acid value of 0.5 mg KOH/g, and had a maximum value at the position of a molecular weight of $1\times10^6$ and $7.5\times10^5$. However, no shoulder existed in a range of at the position of a molecular weight less than $7.5\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd. ) were melted and kneaded at 135° C. by using a mixer. After having been cooled, it was pulverized and classified to obtain a toner having an average particle size of 15 μm. The toner thus obtained was evaluated by the same methods as in Example 17 to find that the anti-offset property, image characteristics, and blocking resistance were excellent, but the fixing property was so poor that the toner was practically unusable.

Comparative Example 14

Emulsion polymerization was conducted under the same conditions as in Example 17 except that 2100 parts by weight of deionized water, 0.035 part by weight of an emulsifier, 256 parts by weight of styrene, 70 parts by weight of n-butyl acrylate, 24.5 parts by weight of methacrylic acid, and 1.7 parts by weight of potassium persulfate were used and polymerization temperature was set at 80° C. Then, suspension polymerization was conducted under the same conditions as in Example 17 except that 650 parts by weight of deionized water, 3.25 parts by weight of a polyvinyl alcohol, 3.25 parts by weight of sodium sulfate, 539.5 part by weight of styrene, 65 parts by weight of n-butyl acrylate, 45.5 parts by weight of methacrylic acid, 3.25 parts by weight of alpha-methylstyrene dimer, 59 parts by weight of benzoil peroxide, and 7.5 parts by weight of t-butylperoxybenzoate were used. Further, a treatment for residual monomers and an alkali treatment were conducted under the same conditions as in Example 17 to obtain a resin.

The resin thus obtained had a softening temperature of 152° C., glass transition temperature of 70° C., and acid value of 45.5 mg KOH/g, and had a maximum value at the position of a molecular weight of $3.9\times10^5$ and $4\times10^3$. Also, a shoulder existed at the position of a molecular weight of $1\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 155° C. by using a mixer. After having been cooled, it was pulverized and classified to obtain a toner having an average particle size of 15 μm. The toner thus obtained was evaluated by the same methods as in Example 17 to find that the blocking resistance was excellent, but the fixing property and image characteristics were so poor that the toner was practically unusable. Also, the resin was rigid and it was inferior even in the pulverizability at the time of toner formation.

Comparative Example 15

Emulsion polymerization was conducted under the same conditions as in Example 17 except that the amount of styrene and n-butyl acrylate were changed to 150 and 50 parts by weight, respectively. Then, suspension polymerization was conducted under the same conditions as in Example 17 except that the amount of styrene and n-butyl acrylate were changed to 600 and 200 parts by weight, respectively. Further, treatment for residual monomers and an alkali treatment were conducted under the same conditions as in Example 17 to obtain a resin.

The resin thus obtained had a softening temperature of 115° C., glass transition temperature of 45° C., and acid value of 0.5 mg KOH/g, and had a maximum value at the position of a molecular weight of $1\times10^6$ and $7.5\times10^3$. Also, a shoulder existed at the position of a molecular weight of $2.5\times10^3$.

On the other hand, 91 parts by weight of the binder resin for toners, 5 parts by weight of a carbon black, 2 parts by weight of a low molecular weight polypropylene wax and 1 part by weight of a charge controlling agent (S-34 manufactured by Orient Chemical Co., Ltd.) were melted and kneaded at 120° C. by using a mixer. After having been cooled, it was pulverized and classified to obtain a toner having an average particle size of 15 μm. The toner thus obtained was evaluated by the same methods as in Example 17 to find that the fixing property, anti-offset property, and image characteristics were excellent, but the blocking resistance was so poor that the toner was practically unusable.

As described above, the binder resin for toners of the third aspect of the present invention can provide toners which are excellent in the fixing property at a low temperature and balanced in the anti-offset property, blocking resistance, and image characteristics, and can cope with the higher speeds of printing by copying machines and printers, by adjusting the resin to have a specific molecular weight distribution, and controlling the softening temperature, glass transition temperature, and acid value.

We claim:

1. A binder resin blend for toners comprising a styrene-vinyl copolymer blend having an acid value ($AV^T$) of not greater than 20 mg KOH/g and an $AV^H/AV^L$ ratio of 0.025 to 40, containing up to no more than 1,000 ppm of residual monomers and/or a residual solvent, and having a glass transition temperature of 50° to 68° C. and a softening temperature of 110° to 145° C., wherein the vinyl monomer component of the copolymers of the blend is selected from the group consisting of (meth)acrylic acid, (meth)acrylic acid esters, maleic acid and esters thereof, fumaric acid and esters thereof, addition monomers of ε-caprolactam with acrylic monomers and bisphenol A adducts of acrylic monomers, the copolymers of the blend being comprised of 15 to 40% by weight of a high molecular weight polymer having a weight average molecular weight of $3\times10^5$ to $1.5\times10^6$ and an acid value ($AV^H$) of 0.5 to 20 mg KOH/g and 60 to 85% by weight of a low molecular weight polymer having a weight average molecular weight of $3\times10^3$ to $6\times10^4$ and an acid value ($AV^L$) of 0.5 to 20 mg KOH/g.

2. The binder resin blend for toners according to claim 1 wherein the high molecular weight polymer has a weight average molecular weight of $4\times10^5$ to $9\times10^5$.

3. The binder resin blend for toners according to claim 1 wherein the low molecular weight polymer has a weight average molecular weight of $4\times10^3$ to $5\times10^4$.

4. The binder resin blend for toners according to claim 1 wherein the content of the high molecular weight polymer is 20 to 35% by weight.

5. The binder resin blend for toners according to claim 1 wherein the content of the low molecular weight polymer is 65 to 80% by weight.

6. The binder resin blend for toners according to claim 1 wherein the high molecular weight polymer has an acid value ($AV^H$) of 0.5 to 15 mg KOH/g.

7. The binder resin blend for toners according to claim 1 wherein the low molecular weight polymer has an acid value ($AV^L$) of 0.5 to 15 mg KOH/g.

8. The binder resin blend for toners according to claim 1 wherein the $AV^H/AV^L$ is 0.025 to 30.

9. The binder resin blend for toners according to claim 1 wherein the acid value ($AV^T$) is not not greater than 15 mg KOH/g.

10. The binder resin blend for toners according to claim 1 wherein the amount of the residual monomers and/or a residual solvent is less than 800 ppm.

11. The binder resin blend for toners according to claim 1 wherein the glass transition temperature is 54° to 66° C.

12. The binder resin blend for toners according to claim 1 wherein the softening temperature is 120° to 140° C.

13. A The binder resin blend for toners according to claim 1 wherein the molecular weight ($M_W{}^H$) of the greatest peak in a high molecular weight region and the molecular weight ($M_W{}^L$) of the greatest peak in a low molecular weight region are in the relationship represented by the following equation (1):

14. A binder resin blend for toners comprising a styrene copolymer prepared from a styrenic monomer and a vinyl monomer, or a blend of styrene-vinyl copolymers, wherein the vinyl monomer of the copolymer or the copolymer of the blend is a member selected from the group consisting of (meth)acrylic monomers, (meth)acrylic monomer esters, maleic acid and esters thereof, fumaric acid and esters thereof, addition monomers of ε-caprolactam with acrylic monomers and bisphenol A adducts of acrylic monomers, having at least one maximum value in the molecular weight region of $10^3$ to $7\times10^4$, at least one maximum value in the molecular weight region of $10^5$ to $2\times10^6$, and a shoulder in the molecular weight region greater than that of $5\times10^5$ in a molecular weight distribution having a maximum value of the greatest molecular weight, all in a chromatogram measured by gel permeation chromatography, wherein the molecular weight ($M_W{}^H$) of the greatest peak in the high molecular weight region and the molecular weight ($M_W{}^L$) of the greatest peak in the low molecular weight region have the relationship expressed by the equation (1):

$$1\times10^6 \geqq M_W{}^H - M_W{}^L \geqq 2\times10^5 \quad (1),$$

and having a melt viscosity of $3\times10^3$ to $10^5$ Pa.S at 120° C., a glass transition temperature of 50° to 68° C. and an acid value of 0.5 to 20 mg KOH/g.

15. The binder resin blend for toners according to claim 14 wherein the resin has a shoulder in the molecular weight region of $6\times10^5$ to $2\times10^6$.

16. The binder resin blend for toners according to claim 14 wherein the resin has a shoulder in the molecular weight region of $6\times10^5$ to $10^6$.

17. The binder resin blend for toners according to claim 14 wherein the high molecular weight polymer having a maximum value in a region of a molecular weight of 105 to $2\times10^6$ is contained in the binder resin blend in an amount of 15 to 45% by weight.

18. The binder resin blend for toners according to claim 14 wherein the melt viscosity at 120° C. is $8\times10^3$ to $8\times10^4$ Pa.S.

19. The binder resin blend for toners according to claim 14 wherein the glass transition temperature is 54 to 66° C.

20. The binder resin blend for toners according to claim 14 wherein the softening temperature is 120° to 140° C.

21. A binder resin blend for toners comprising a styrene copolymer prepared from a styrenic monomer and a vinyl monomer, or a blend of styrenic-vinyl copolymers, wherein the vinyl monomer is a member selected from the group consisting of (meth)acrylic monomers, (meth)acrylic monomer esters, maleic acid and esters thereof, fumaric acid and esters thereof, addition monomers of ε-caprolactam with acrylic monomers and bisphenol A adducts of acrylic monomers, having at least one peak in the molecular weight region of 103 to $7\times10^4$ and the molecular weight region of $10^5$ to $2\times10^6$ respectively, and having a shoulder in the molecular weight region less than that of a maximum value of the peak in the molecular weight region of $2\times10^3$ to $6\times10^4$, all in the molecular weight distribution by gel permeation chromatography, and having a glass transition temperature of 50° to 68° C., a softening temperature of 110° to 145° C., and an acid value of not greater than 40 mg KOH/g.

22. The binder resin blend for toners according to claim 21 wherein the resin has a peak in the molecular weight region of $2\times10^3$ to $6\times10^4$ and the region of molecular region of $3\times10^5$ to $2\times10^6$, respectively.

23. The binder resin blend for toners according to claim 21 wherein the glass transition temperature is 54° to 66° C.

24. The binder resin blend for toners according to claim 21 wherein the softening temperature is 120° to 140° C.

25. The binder resin blend for toners according to claim 21 wherein the molecular weight ($M_W^H$) of the greatest peak in a high molecular weight region and the molecular weight ($M_W^L$) of the greatest peak in a low molecular weight region are in the relationship represented by the following equation (1):

$$1\times10^6 \geqq M_W^H - M_W^L 2\times10^5 \quad (1)$$

26. The binder resin blend of claim 1, wherein said acrylic monomer is 2-ethylhexyl acrylate present is in the copolymer in an amount of 5 to 30% by weight or diethylaminoethyl methacrylate present in the copolymer in an amount of 0.1 to 5% by weight.

* * * * *